US008674926B2

(12) United States Patent
Nitta

(10) Patent No.: US 8,674,926 B2
(45) Date of Patent: Mar. 18, 2014

(54) IMAGE DISPLAY DEVICE AND IMAGE DISPLAY METHOD USING BLACK DISPLAY

(75) Inventor: Takashi Nitta, Chino (JP)

(73) Assignee: Seiko Epson Corporation, Tokyo (JP)

( * ) Notice: Subject to any disclaimer, the term of this patent is extended or adjusted under 35 U.S.C. 154(b) by 1339 days.

(21) Appl. No.: 11/902,151

(22) Filed: Sep. 19, 2007

(65) Prior Publication Data

US 2008/0100645 A1 May 1, 2008

(30) Foreign Application Priority Data

Sep. 20, 2006 (JP) ..... 2006-254506
Sep. 5, 2007 (JP) ..... 2007-230346

(51) Int. Cl.
*G09G 3/36* (2006.01)

(52) U.S. Cl.
USPC ..... 345/102; 345/89

(58) Field of Classification Search
USPC ..... 345/84, 87–104, 697
See application file for complete search history.

(56) References Cited

U.S. PATENT DOCUMENTS

| | | | | |
|---|---|---|---|---|
| 2004/0095402 | A1* | 5/2004 | Nakano | 346/102 |
| 2005/0162737 | A1 | 7/2005 | Whitehead et al. | |
| 2005/0184952 | A1* | 8/2005 | Konno et al. | 345/102 |
| 2005/0231457 | A1* | 10/2005 | Yamamoto et al. | 345/102 |
| 2005/0275616 | A1* | 12/2005 | Park et al. | 345/102 |
| 2006/0007097 | A1* | 1/2006 | Ichikawa | 345/102 |
| 2007/0132706 | A1* | 6/2007 | Nishimura et al. | 345/102 |
| 2007/0188438 | A1* | 8/2007 | Fletcher et al. | 345/102 |
| 2007/0285378 | A1* | 12/2007 | Lankhorst et al. | 345/102 |

FOREIGN PATENT DOCUMENTS

| | | |
|---|---|---|
| JP | A-2000-180824 | 6/2000 |
| JP | A-2002-099250 | 4/2002 |
| JP | A-2004-317895 | 11/2004 |
| JP | A-2005-520188 | 7/2005 |
| JP | A-2005-258403 | 9/2005 |
| JP | A-2006-091236 | 4/2006 |
| JP | A-2007-052105 | 3/2007 |

OTHER PUBLICATIONS

Shiga et al, "Reduction of LCTV Backlight Power and Enhancement of Gray Scale Capability by Using an Adaptive Dimming Technique", SID Symposium Digest of Technical Papers—May 2003—vol. 34, Issue 1, pp. 1364-1367.*

Shirai et al.; "RGB-LED Backlights for LCD-TVs with 0D, 1D, and 2D Adaptive Dimming;" *SID 06* Digest, pp. 1520-1523 Jun. 8, 2006.

* cited by examiner

*Primary Examiner* — Bipin Shalwala
*Assistant Examiner* — Keith Crawley
(74) *Attorney, Agent, or Firm* — Oliff PLC

(57) ABSTRACT

An image display device includes: an optical modulation element having a plurality of pixels; light sources illuminating the optical modulation element, each of which is independently controlled; a light source control value setting section setting control values for each of the light sources according to the grayscale of each pixel of an input image; optical sensors provided on areas of "n" pixels, respectively, where the "n" is an integer equal to or greater than 1; an illumination detection section detecting the illumination of the areas by the optical sensors; and a grayscale control section processing to correct grayscale of each pixel based on the detected illumination and controlling the optical modulation element according to the corrected grayscales obtained by correction.

10 Claims, 12 Drawing Sheets

ONLY ONE LIGHT LIT

THREE LIGHTS ALL LIT

IMAGE DISPLAY DEVICE AND IMAGE DISPLAY METHOD USING BLACK DISPLAY

CROSS-REFERENCE TO RELATED APPLICATION

This application claims priority from Japanese Patent Application No. 2006-254506, filed on Sep. 20, 2006, and from Japanese Patent Application No. 2007-230346, filed on Sep. 5, 2007, the entire contents of which are incorporated herein by reference.

BACKGROUND

1. Technical Field

This invention relates to an image display device which displays grayscale images, and in particular relates to an image display device and image display method suitable for display with a large number of grayscales.

2. Related Art

Recent years have seen stunning improvements in the image quality of LCDs (Liquid Crystal Displays), EL (Electroluminescence) displays, CRTs (Cathode Ray Tubes), projection-type display devices, and other electronic display devices.

Devices are being manufactured which have resolution and color gamut substantially comparable to those of human perception characteristics.

However, the reproducible dynamic range for luminance is at most approximately 1 to 102 nits.

Furthermore, 8 bits are used to represent grayscales in general.

In general, the luminance dynamic range which can be perceived by humans at once is approximately $10^{-2}$ to $10^{4}$ nits, and luminance discrimination ability is 0.2 nit.

When a luminance dynamic range is converted into a number of grayscales corresponding to this luminance discrimination ability, it is thought that a quantity of data equivalent to approximately 12 bits is required.

When the display screen of a current electronic display device is viewed via the above-described perception characteristics, the narrowness of the luminance dynamic range is prominent. In addition, grayscale resolution in shadow portions and in highlight portions is insufficient.

For this reason, there is a sense of insufficient realism and vigor in the displayed image.

In CG (Computer Graphics) images used in movies, games, or the like, a tendency has emerged to impart to the data a luminance dynamic range and grayscale characteristic close to those of human perception, in the pursuit of more realistic depictions.

However, because the performance of electronic display devices is inadequate, when displaying the above CG content images, there is the problem in that the expressiveness (the number of bits representing grayscales) inherent in the images of CG content cannot be adequately displayed.

Furthermore, in subsequent versions of Windows (a registered trademark), there are plans to adopt a 16-bit color space, so that the dynamic range and number of grayscales will be greatly increased over the current 8-bit color space.

Hence, there are expected to be mounting demands for electronic display devices with a high dynamic range and large number of grayscales, capable of fully exploiting the 16-bit color space of CG content.

In such electronic display devices, various proposals have been made to expand the above-described luminance dynamic range.

For example, as disclosed in Japanese Unexamined Patent Application, First Publication No. 2002-99250, in Published Japanese Translation No. 2005-520188 of PCT International Publication, in Japanese Unexamined Patent, First Publication Application No. 2004-317895, and in Japanese Unexamined Patent Application, First Publication No. 2005-258403, configurations are proposed in which a light source in which dimming is possible is used, and as the backlight of a liquid crystal display device, an illumination distribution with illumination differing by area is generated in a form corresponding to the illumination distribution of the video signal (image data), to increase the dynamic range of the video space and increase the number of grayscales, while reducing power consumption.

An important point of each of the above references is the fact that due to the brightness of the backlight, control values (for example, voltage values controlling the transmittance of liquid crystal elements) are set for each pixel of the liquid crystal display device.

Hence, the backlight brightness at each pixel of the liquid crystal display device must be calculated and must be detected.

However, in each of the above references, calculation of the backlight brightness at each pixel is in essence performed using open-loop processing.

In other words, as the backlight brightness at each pixel, predicted values based on numerical values measured in advance are used.

Each of the brightness steps of the backlight, that is, each of the illumination distributions resulting from settings in a control step, is stored in advance in memory as a formula or as a value in a table.

When the backlight is set to a certain brightness, the illumination distribution in areas illuminated by light corresponding to this brightness is calculated using the above-described formula or is read from a table, and the illumination values of corresponding pixel positions are used as illumination values for the pixels.

However, in the methods of the above-described references, when uniform display is performed as in the case of "white" display over the entire image, the illumination distribution of light emitted from the light sources used as individual backlights must be broad to a certain extent, as in a Gaussian distribution, in order to prevent luminance unevenness and false contours, and moreover it is desirable that the illumination distributions of the light sources overlap.

Here, when focusing on a certain pixel, the illumination distributions of all light sources which affect the illumination for the pixel must be considered, to determine the actual illumination for the pixel.

Hence, in the methods of the above-described references, the distribution information or the like for the light sources result in a large amount of data and extreme complexity, and when illumination distributions are to be determined by computation, the circuitry and processing time required for computation are considerable.

Furthermore, when values calculated in advance are stored and are then read out, there is the problem in that large memory capacity is necessary to store illuminations for each pixel corresponding to the above-described distribution information.

In particular, in the methods of the above-described references, processing time for computation is increased, and time is required to read illuminations for each pixel from memory, so that real-time calculation of illuminations for each pixels is difficult, and motion images cannot be displayed.

Moreover, the problem of the need for a large amount of time and memory for the above-described computation processing increases exponentially as the number of light sources and the number of control steps of the light source brightness increase.

SUMMARY

An advantage of some aspects of the invention is to provide an image display device and an image display method, in which the time and memory required for computation processing do not increase as the number of light sources and the number of control steps of the light source brightness increase, which determines the illumination distribution quickly compared with the prior art and by a simple circuit, and which can perform image display with a broad dynamic range and large number of grayscales.

A first aspect of the invention provides an image display device, including: an optical modulation element having a plurality of pixels; light sources illuminating the optical modulation element, each of which is independently controlled; a light source control value setting section setting control values for each of the light sources according to the grayscale of each pixel of an input image; optical sensors provided on areas of "n" pixels, respectively, where the "n" is an integer equal to or greater than 1; an illumination detection section detecting the illumination of the areas by the optical sensors; and a grayscale control section processing to correct grayscale of each pixel based on the detected illumination and controlling the optical modulation element according to the corrected grayscales obtained by correction.

A second aspect of the invention provides an image display method, including: illuminating an optical modulation element having a plurality of pixels by light sources, each of the light sources being independently controlled; setting control values for each of the light sources by a light source control value setting section according to the grayscale of each pixel of an input image; detecting the illumination of areas by an illumination detection section and by optical sensors provided on areas of "n" pixels, respectively, where "n" is an integer equal to or greater than 1; processing to correct the grayscale for each pixel by a grayscale control section, and controlling the optical modulation element according to the corrected grayscales obtained by correction, based on the detected illumination.

According to the image display device (or method) of this invention, the brightness of light with which each pixel is illuminated is not obtained by computation, and is not obtained by reading numerical values stored in memory, as in the prior art, but is directly detected by optical sensors.

As a result, the illumination corresponding to each pixel can be obtained rapidly and with high precision compared with the prior art, without complex computations or the need to provide large-capacity memory.

Furthermore, grayscales can be computed for each pixel in real-time, so that application to motion images is also possible.

That is, by an image display device of this invention, each light source can be controlled corresponding to the grayscales of input image data.

The illumination of light with which each pixel is actually illuminated is measured.

Grayscales of image data corresponding to each pixel are corrected according to the measured illumination, and fine adjustment is performed corresponding to the input grayscales.

Hence more precise image display can be performed compared with the prior art, and a broad dynamic range can be achieved.

Furthermore, by an image display device of this invention, because illumination is measured directly, increases in the number of backlight light sources, and increases in the number of control steps of the brightness thereof (indicating the number of stages of numerical changes in the light source brightness; for example, control steps to control the light source brightness in 24 stages), can easily be accommodated.

Moreover, control can be performed to obtain brightness close to the theoretical values corresponding to grayscales for displayed pixels, and power conservation can be improved compared with the prior art.

In general, the average luminance level for an image is thought to be approximately 20%.

On the other hand, by an image display device of this invention, the power to drive the light sources can theoretically be reduced to ⅕ that required when irradiating the optical modulation element with light of uniform illumination over the entire surface.

Moreover, by an image display device of this invention, because illumination is measured directly, changes in the configuration of light sources with respect to the optical modulation element (for example, the number of light sources, the positions of placement of light sources, changes in control steps, scattering in light source brightness) can easily be accommodated.

Furthermore, the image display device can easily be designed and manufactured.

Furthermore, by an image display device of this invention, the light source brightness during black display relative to darkroom contrast can be reduced in comparison with the prior art.

As a result, an extremely high contrast ratio of several tens of thousand to one can be achieved.

It is preferable, in that the image display device of the first aspect of this invention, the optical sensors and the optical modulation element be formed on the identical substrate.

In the image display device of this invention, by forming the optical sensors and the optical modulation element on the identical substrate, the optical sensors and optical modulation element are formed on the identical substrate with the pixels, and illumination due to light incident onto pixels can be detected at positions close to the pixels.

That is, a value similar to the brightness of light with which pixels are actually illuminated can be detected, and each of the light sources and the grayscales for each pixel can be controlled with high precision.

It is preferable, in that the image display device of the first aspect of this invention, the optical sensors be provided on the pixels, respectively.

In the image display device of this invention, through the above-described configuration, the optical sensors detect the illumination of each pixel, and so the illumination can be detected for the same light that is incident onto each pixel.

That is, the identical illumination value can be detected for the light actually irradiating the pixels of the optical modulation element, and so each of the light sources and the grayscales for each pixel can be controlled with high precision.

It is preferable, in that the image display device of the first aspect of this invention, the optical sensors be provided on the areas of the pixels equal to or less than 40×40.

That is, it is preferable that the optical sensors be provided in each area having at most 40 pixels in a vertical direction and 40 pixels in a horizontal direction.

In the image display device of this invention, through the above-described configuration, the illumination is detected by optical sensors in areas of 40×40 pixels, and display element control is performed according to this illumination.

As a result, power conservation can be improved (see the reference: "RGB-LED Backlights for LCD-TVs with 0D, 1D, and 2D Adaptive Dimming", T. Shirai et al, pp. 1520-1523, SID 06).

It is preferable, in that the image display device of the first aspect of this invention, the grayscale control section performs black display control so as to display black in all pixels of the optical modulation element during a correction processing period to determine the corrected grayscales.

In the image display device of this invention, through the above-described configuration, time differences between a change in brightness of a light source and a change in display elements of the optical modulation element in which the grayscales thereof are controlled according to this brightness are absorbed, and changes in pixel luminance are made difficult to recognize, so that image quality can be improved.

Furthermore, by the image display device of this invention, black display control is performed corresponding to changes in the image, so that display blurring is improved through the effect of black insertion, and the video response can be improved.

It is preferable, in that the image display device of the first aspect of this invention, the light source control value setting section turn all of the light sources off in synchronization with the black display control.

Through this configuration, by the image display device of this invention, light sources are turned off in synchronization with the timing of black display control of the display elements (corresponding to pixels), and black insertion is performed through the light sources.

Hereby, shifts in the time required until complete black display of display elements are absorbed, so that changes in pixel luminance are not easily recognized, and image quality can be improved.

Furthermore, by the image display device of this invention, black display control is performed corresponding to changes in the image, so that display blurring is improved through the effect of black insertion, and the video response can be improved.

It is preferable, in that the image display device of the first aspect of this invention, the light source control value setting section set control values for the light sources every "k" frames where the "k" is an integer equal to or greater than 2, the illumination detection section detect the illumination of the areas every "k" frames, and the grayscale control section control the optical modulation element due to the corrected grayscales every a single-frame.

In the image display device of this invention, through the above-described configuration, the number of iterations of processing in illumination detection can be decreased, and the processing load when adjusting the light source brightness can be reduced.

It is preferable that the image display device of the first aspect of this invention, further include a scene change detection section detecting whether an image data has been input in the period of "k" frames, the image data having grayscales which is impossible to display at the current illumination distribution of light source. In this configuration, the light source control value setting section sets the light sources to a full-screen dimming mode, which is substantially the same illumination corresponding to the maximum grayscale in the image data, when the scene change detection section detects the fact that the image data is impossible to display at the current illumination distribution. Furthermore, the light source control value setting section sets an area dimming mode in which control values for each of the light sources are set according to grayscales of the pixels for the input image at the timing of the next illumination detection by the illumination detection section.

In the image display device of this invention, through the above-described configuration, when controlling the illumination of each light source over a plurality of frame periods, the illumination of each light source can be controlled corresponding to grayscales of the pixels of the image data.

Specifically, when displaying input image data for each frame, even when grayscales of the pixels change greatly every each area within the frame period, the illumination of each light source can be controlled according to the grayscales of the pixels of the image data.

Hereby, accurate reproduction of the luminance of image data can be performed even when there are scene changes in which grayscales change rapidly.

It is preferable, in that the image display device of the first aspect of this invention, the scene change detection section compare grayscales of all pixels of input image data with the range of grayscales which is possible to display at the current control values of each light source, and the scene change detection section determine whether the image data has been input, the image data being impossible to reproduce at the current illumination of light source due to whether the grayscales of all of the pixels are within the range.

In the image display device of this invention, through the above-described configuration, grayscales of image data are detected for all pixels as being within or outside the range of grayscales which can be displayed for the current control values of each light source, so that highly precise determinations can be made.

It is preferable, in that the image display device of the first aspect of this invention, the scene change detection section detect scene changes of the image data (for example, by comparing histograms of grayscales between frames to detect large changes in the shapes of histograms), and hereby determine whether there exists input image data which cannot be reproduced for the current light source illuminations.

According to the above configurations, by the image display device of this invention, the grayscales of the image data are detected for all pixels as being within or outside the range of grayscales which can be displayed for the current control values of each of the light sources, so that highly precise determinations can be performed.

According to the above configurations, by the image display device of this invention, scene changes can easily be detected using a simple configuration, and so devices can be configured at low cost.

DESCRIPTION OF EXEMPLARY EMBODIMENTS

First Embodiment

Figure 1:
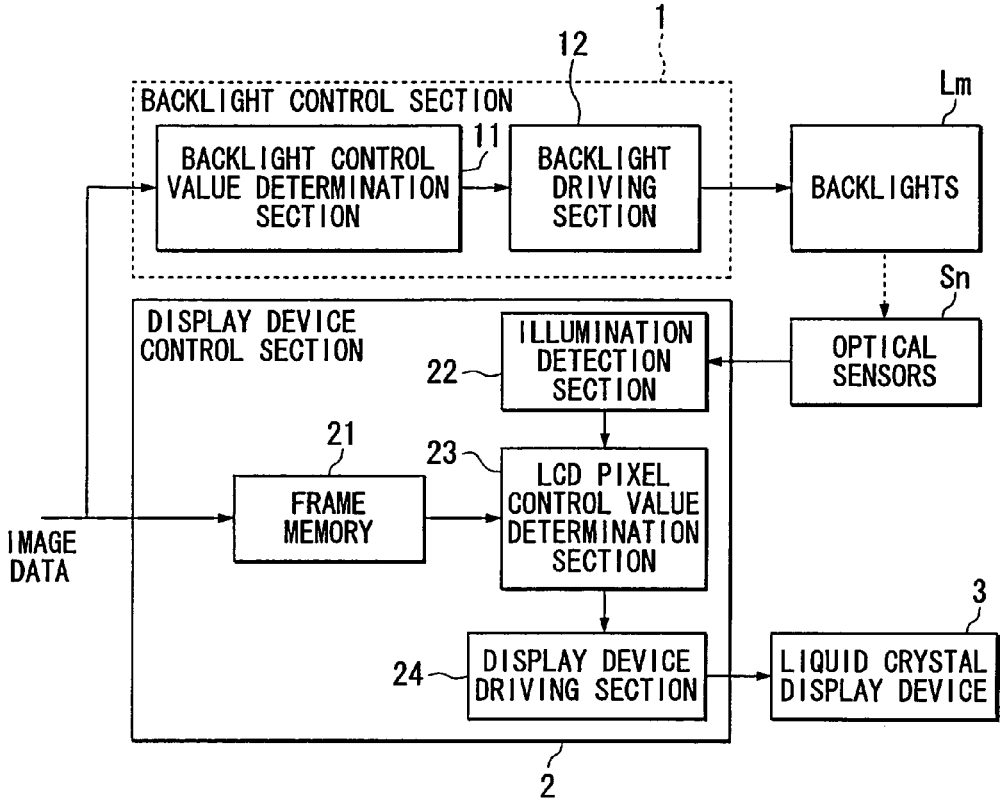
FIG. 1 is a block diagram showing the configuration of the image display device of a first embodiment of the invention.

Below, the image display device of a first embodiment of the invention is explained, referring to the drawings.

FIG. 1 is a block diagram showing an example of the configuration of the embodiment.

In the figure, the backlight control section 1 independently controls each of the backlights (light sources) (for example, if there are m backlights, then the backlights are L1 through Lm) provided on the optical modulation element, which for example is a liquid crystal display device 3.

The backlight control section 1 includes a backlight control value determination section 11 and a backlight driving section 12.

The backlight control value determination section 11 detects, in the input image data, the maximum grayscale value (highest luminance value) among the grayscales of the image data corresponding to pixels included in the pixel area associated with each of the above backlights, and determines the brightness control value (backlight control value) for each backlight corresponding to this maximum grayscale value.

The backlight driving section 12 determines the voltage value corresponding to the above-described brightness control value for each pixel area, drives the respective backlights at these control values, and controls lighting of the backlights to the brightness corresponding to the maximum grayscale value for the corresponding pixel areas.

The display device control section 2 detects the illumination distribution in the liquid crystal display device 3.

The display device control section 2 determines the new grayscales from the detected illumination and the grayscales of the pixels.

That is, the display device control section 2 corrects grayscales of the pixels based on the detected illumination, to obtain corrected grayscales corresponding to the illumination.

The display device control section 2 controls the transmittance of the liquid crystal elements (display elements) corresponding to each pixel of the liquid crystal display device 3, according to the corrected grayscales.

The display device control section 2 includes frame memory 21, an illumination detection section 22, an LCD pixel control value determination section 23, and a display device driving section 24.

Here, the illumination distribution of light when each of the backlights illuminates the liquid crystal display device 3 is detected.

Therefore, the display surface formed by the pixels of the liquid crystal display device 3 are divided into a plurality of illumination detection areas, each including "n" pixels (where "n" is equal to or greater than one), and one optical sensor S is provided on each of the illumination detection areas.

Here the illumination detection areas are formed by dividing the display surface into a number of areas at least equal to or greater than the number of backlights, or equal to a number, set in advance, corresponding to all the pixels of the display surface.

The frame memory 21 takes as input the identical image data with the image data input to the backlight control section 1, and stores one frame's worth of the image data, that is, the data for the pixels of the display screen.

The illumination detection section 22 determines illumination data T for each of the illumination detection areas from detected illumination values, which are the numerical values for the illumination of corresponding illumination detection areas input from the optical sensors S.

For example, the illumination detection section 22 has a table which divides illumination values, from the illumination value detected when a backlight measured in advance is put into the turned off state, to the maximum illumination value detected when the backlight is at maximum brightness, by a plurality of levels (for example 256 stages, from 0 to 255).

The illumination detection section 22 selects illumination data T including the detected illumination value input from the optical sensor S as the illumination value for that illumination detection area.

The LCD pixel control value determination section 23 determines corrected grayscales from the grayscales of the image data read from frame memory 21 and from the above illumination data T, and uses the corrected grayscales to output transmittance control values (voltage values) which control the transmittance of liquid crystal elements.

The liquid crystal device driving section 24 uses the above transmittance control values to control the transmittance of the liquid crystal elements for each pixel of the liquid crystal display device 3.

Figure 2:
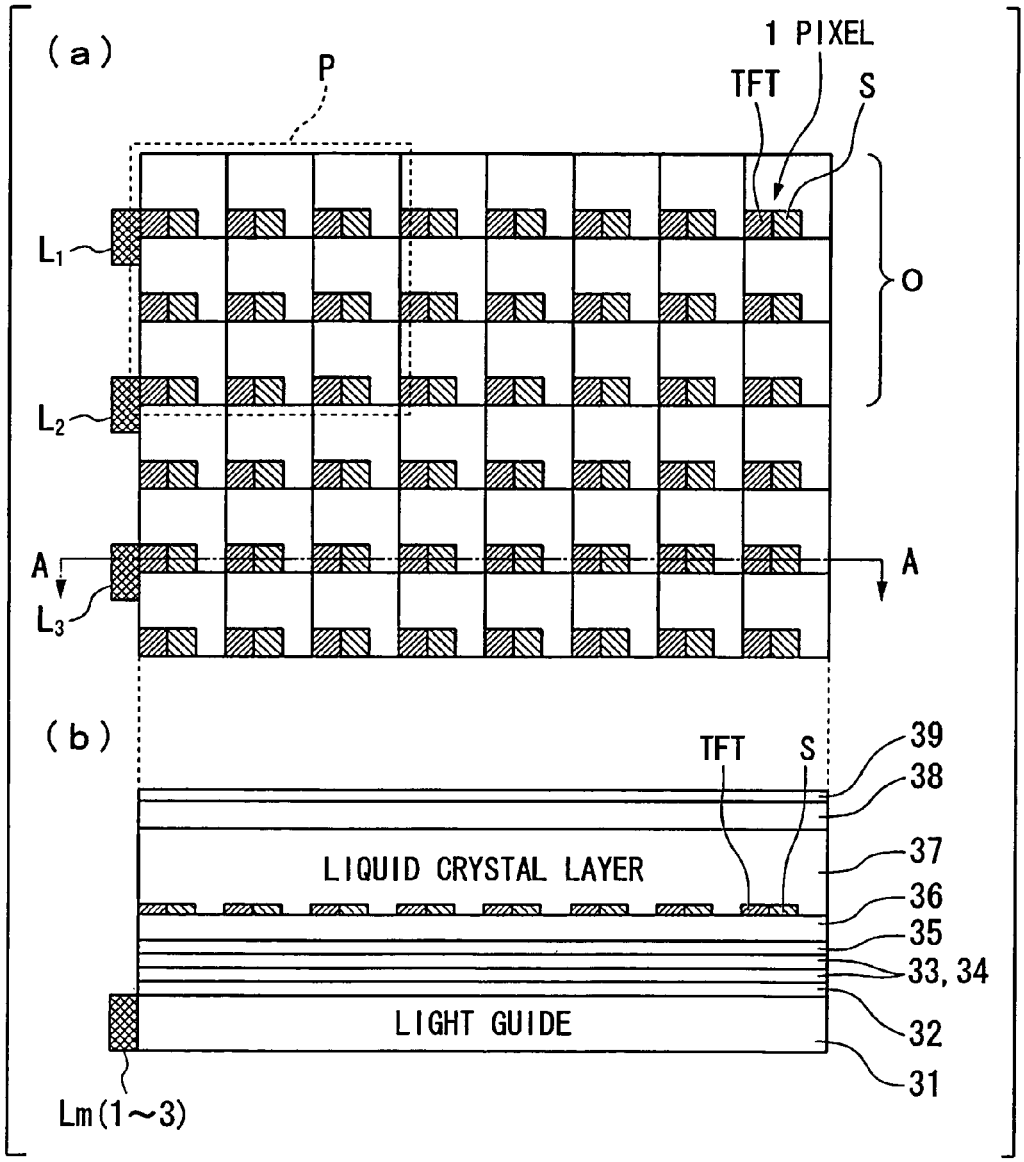
FIG. 2 is a conceptual diagram, in which Part (a) and Part (b) show the configuration of a liquid crystal display device in the image display device of FIG. 2.

Next, FIG. 2 is used to explain the relation between backlights and pixel areas, and the relation between optical sensors and illumination detection areas.

Part (a) and Part (b) in FIG. 2 are conceptual diagrams of the display hardware configuration, showing an example of the positioning of backlights and optical sensors relative to the liquid crystal display device 3 in this embodiment.

Part (a) of FIG. 2 shows the surface of the liquid crystal display device 3; Part (b) of FIG. 2 is a conceptual diagram showing the cross-section view taken along the line A-A in Part (a) of FIG. 2.

In order from the lower layers, the liquid crystal display device 3 includes, as shown in Part (b) of FIG. 2, for example, a light guide 31, a diffusion plate 32, prism sheets 33 and 34, a polarizing plate 35, a transparent substrate 36, a liquid crystal layer 37, a transparent substrate 38, and a polarizing plate 39.

The liquid crystal display device 3 is for example an active matrix display employing TFTs (thin film transistors), and has 8 pixels horizontally by six pixels vertically (that is, a matrix of six rows and eight columns), for a total of 48 pixels.

Furthermore, when the liquid crystal display device 3 is a color device, each pixel corresponds to the three primary colors of R (Red), G (Green), and B (Blue).

The pixels are positioned periodically such that, in the above matrix, edges are not in contact and pixels are not adjacent.

The backlights L are a total of three backlights L1, L2, and L3 (that is, m=3 in FIG. 1), positioned on one edge portion in the length direction of the light guide 31 with one for every two rows of the liquid crystal display device 3, so as to illuminate the interior of the light guide 31 with light.

Hence for the positions of the backlights L above, the pixel areas (areas O in Part (a) of FIG. 2) each includes two rows of pixels of the liquid crystal display device 3.

Furthermore, the backlights L may be positioned below the light guide 41, so as to illuminate the surface of the liquid crystal display device 3 with vertically incident light.

The optical sensors S are configured such that one sensor is placed in each pixel (that is, in FIG. 1, n=1), or in other words, the illumination detection area is a single pixel. The optical sensors S are formed on the identical transparent substrate 36 with the TFTs, and measure the illumination of light emitted from the transparent substrate 36.

That is, the direction of light reception of the optical sensors S is the downward direction perpendicular to the surface of the liquid crystal display device (the direction opposing the diffusion plate 32), in order to measure the illumination of light illuminated from the backlights L.

Here, by setting n=1, when setting the transmittance control value for the display elements of each pixel, the LCD pixel control value determination section 23 reads, from the illumination detection section 22, the illumination data T for optical sensors corresponding to pixels displaying image data, for the grayscales of image data read in order from frame memory 21, and determines the transmittance control values for liquid crystal elements for each pixel of the liquid crystal display device. As a result, the processing circuitry is extremely simple.

Furthermore, By forming the optical sensors S on the identical transparent substrate 36 with the TFTs, the same semiconductor processes as are used for the TFTs can be employed, and the optical sensors S can be formed simultaneously with the TFTs. Hence processes to manufacture the liquid crystal display device 3 are simplified, and the advantages of mass production enable reductions in cost.

Furthermore, as shown in Part (b) of FIG. 2, the backlights L (LED light sources) are side-light devices which illuminate light from the side onto the diffusion plate 31 of the liquid crystal display device 3.

The light illuminated from the backlights L is reflected from above and incident onto the diffusion plate 32, so as to be substantially uniform in the lateral direction in Part (b) of FIG. 2 by the guide plate 31.

Then the light, having passed through the diffusion plate 32, is rendered uniform by the prism sheets 33 and 34, and is incident onto the polarizing plate 35, to obtain light with uniform polarization.

This light with uniform polarization passes through the transparent substrate 36 on which the TFTs and optical sensors S are formed, and has its polarization state modulated by the liquid crystal layer 37, the orientation of the liquid crystal layer 37 is controlled according to the transmittance control values applied to the TFTs.

After modulation of the polarization state, the light passes through the transparent substrate 38, and the amount of light emitted is determined by the polarization state and by the emission-side polarizing plate 39.

Figure 3A:
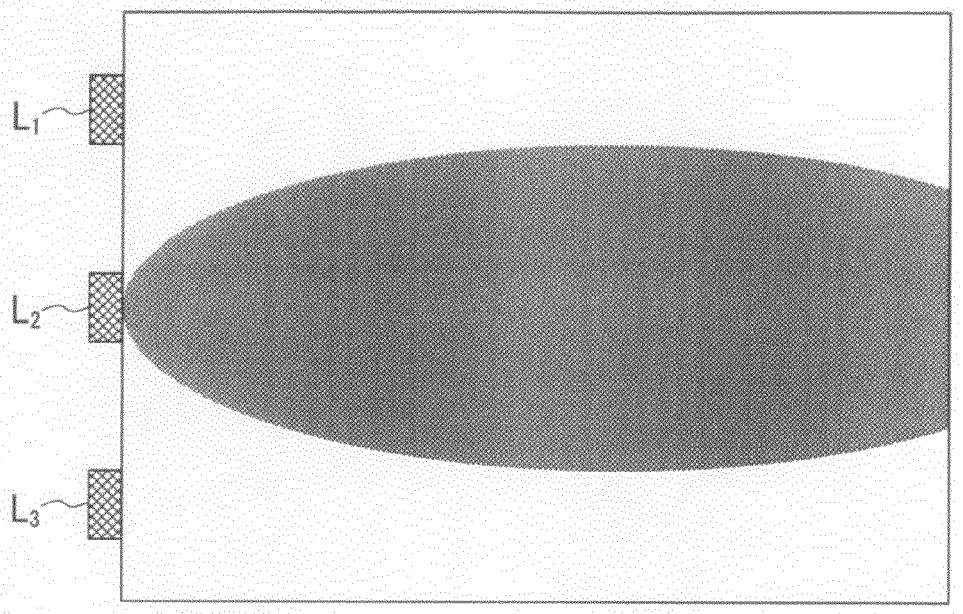
FIGS. 3A and 3B are conceptual diagrams explaining the illumination distribution over a diffusion plate for light emitted from a backlight in a liquid crystal display device.
Figure 3B:
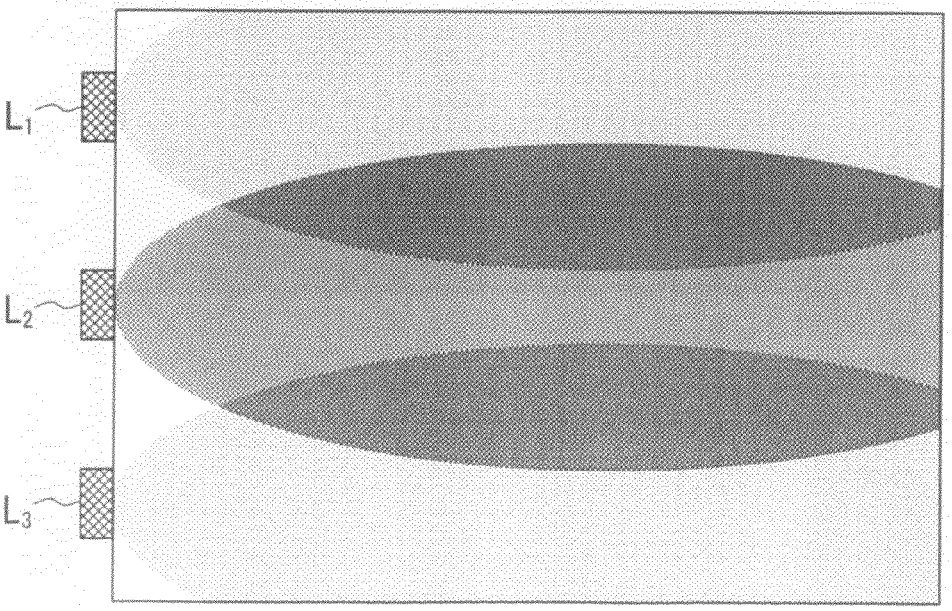

Next, FIGS. 3A and 3B are conceptual diagrams showing the illumination distributions of light illuminated from backlights L.

In FIGS. 3A and 3B, deeper colors indicate higher brightnesses.

As shown in FIG. 3A, the light from a single backlight, such as for example the light emitted from backlight L2, is diffused within the diffusion plate 31, and the brightness is broadened in the vicinity of the edge portions due to the diffusion.

Furthermore, as shown in FIG. 3B, when each of the three backlights L1 to L3, in positions at prescribed distances, is lighted with different brightnesses, the illumination of the illuminated light is determined by the overlapping of light from two light sources, depending on the position of the pixel.

Figure 4A:
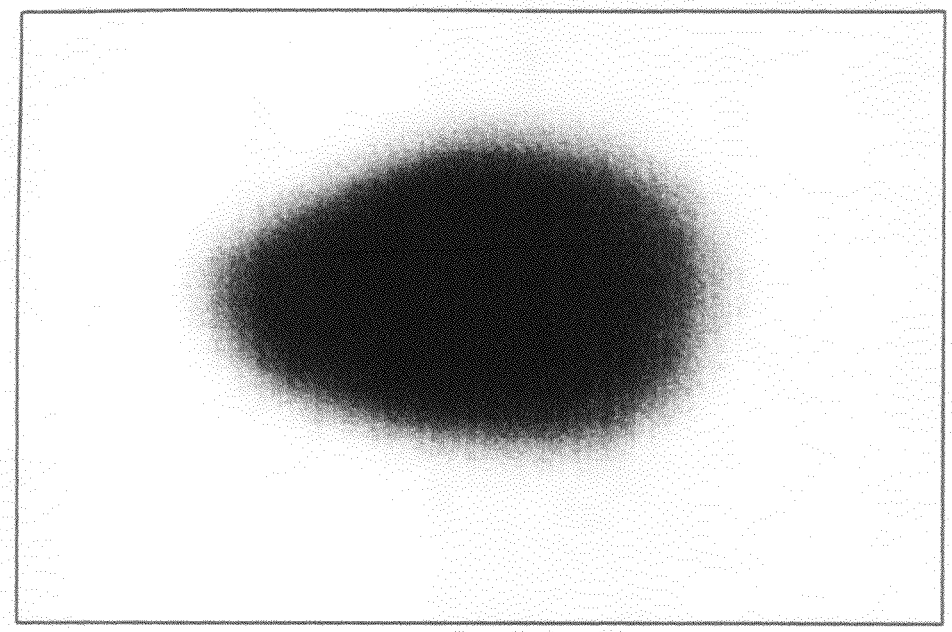
FIGS. 4A and 4B are conceptual diagrams explaining the illumination distribution over a diffusion plate for light emitted from a backlight in a liquid crystal display device.
Figure 4B:
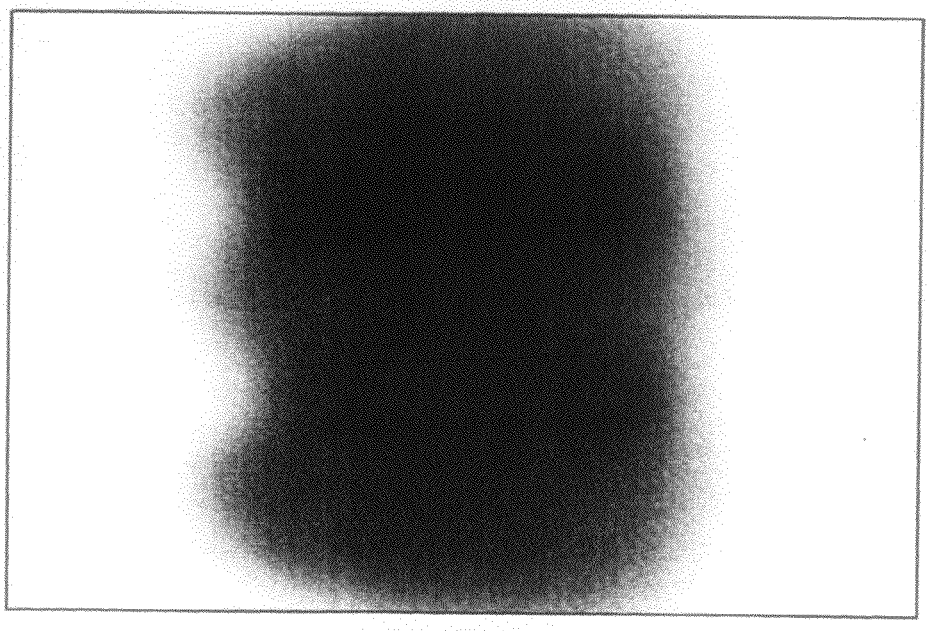

FIGS. 4A and 4B show examples in which the illumination distributions of light illuminated from backlights have a nearly Gaussian distribution.

Similarly to FIGS. 3A and 3B, deeper colors indicate higher brightnesses.

FIG. 4A is a case in which a single backlight (for example backlight L1 in FIGS. 3A and 3B) is lit. FIG. 4B shows the illumination distribution when each of three backlights, in positions at prescribed distances (for example, backlights L1 to L3 in FIGS. 3A and 3B), is lit.

As shown in FIGS. 4A and 4B, actual illumination distributions are thought to differ in detail in this way. Also, when considering a certain pixel, calculation of the illumination distribution for that pixel requires extremely complicated processing.

However, in this embodiment, optical sensors are provided on pixels (or for each illumination detection area), respectively, and the illumination of an area illuminated by light from backlights is measured in real-time for each illumination detection area, so that the illumination distribution of light from backlights can be obtained extremely simply in every pixel (or every illumination detection area).

Because the grayscales of the image data are corrected for illumination, the illumination must be detected accurately in order to calibrate the optical sensors S.

With respect to this detection, a configuration is employed in which a separate uniform sheet light source or the like is used to perform calibration of the voltage values driving the liquid crystal elements for the light quantity incident onto the optical sensors, and the calibration values are stored; for example, transmittance control values are detected as driving voltages for liquid crystal elements for the illumination data T (light quantity) of each of the optical sensors, and a table of the correspondence between transmittance control values and corrected grayscales is generated.

As explained above, the image display device of this embodiment is a liquid crystal display device which uses a plurality of LED light sources, the luminances of which can be controlled as light sources, as the backlights L.

By setting each of the backlights to various brightness control values and modifying the luminance, the illumination distribution of light in areas illuminated by the backlights can be controlled for each pixel area.

For example, when input image data is such that the left half of the image is close to black, by controlling the backlights such that the brightness of light in the left half is reduced, both a display with high dynamic range, with lack of black saturation avoided, and reduced power consumption can be achieved simultaneously.

The above-described reference describes in detail the advantageous results when the brightness of light illuminated from backlights and the transmittance of the liquid crystal elements of pixels are controlled such that, for each pixel area, the illumination takes on a value according to the image data for the illuminated area.

That is, according to this reference, the power conservation effect is substantial when the number of display pixels per dimming area is less than 40 pixels by 40 pixels, and when there are greater than 24 backlight brightness control steps.

Over this range of 40 pixels by 40 pixels, when full Hi-Vision resolution (1920×1080) is to be controlled, a simple calculation indicates that 48×27=1296 illumination detection areas are required as dimming areas.

In the case of QVGA (Quarter VGA, 320×240) also, 8×6=48 illumination detection areas are required, and moreover equal to or greater than 24 control steps are necessary.

When the number of dimming areas and the number of light source control steps increase in this way, as already explained, in the case of a configuration of the prior art the resources necessary to determine the illumination distribution in every pixel (the circuitry, memory amount, and computation time) become enormous.

Moreover, in order to store illumination distribution data or the like in memory, there is also a rapidly increase in the number of measurement steps to measure the illumination distribution in advance.

Hence in this embodiment, as explained above, rather than calculating the illumination distribution based on measurements or determining the illumination distribution from distribution data, the illumination in pixels is actually measured in real-time, by optical sensors provided in every pixel.

Hereby, even when the illumination distribution due to light illuminated from backlights is complex, by performing simple grayscale correction processing of the illumination for each pixel, an image display device capable of display with high image quality can be provided.

In this method, the illumination is measured in real-time, and so grayscale correction processing can be accomplished easily, without being affected by aging, thermal changes or other changes in the backlights (light sources), and without requiring any special processing.

Normally photodiodes or the like are used for the optical sensors S. In this embodiment, photodiodes also are used.

However, apart from photodiodes, various other configurations are conceivable, such as using phototransistors, or providing the TFTs used to control the liquid crystal elements of pixels with a photosensing function, that is, configured as a phototransistor.

In addition, the optical sensors S may be formed on the prism sheet 34, in positions overlapping in plane view the respective illumination detection areas which are to be measured.

Next, operation of the image display device of this embodiment is explained using FIGS. 1, 2, 5, and 6.

Figure 5:
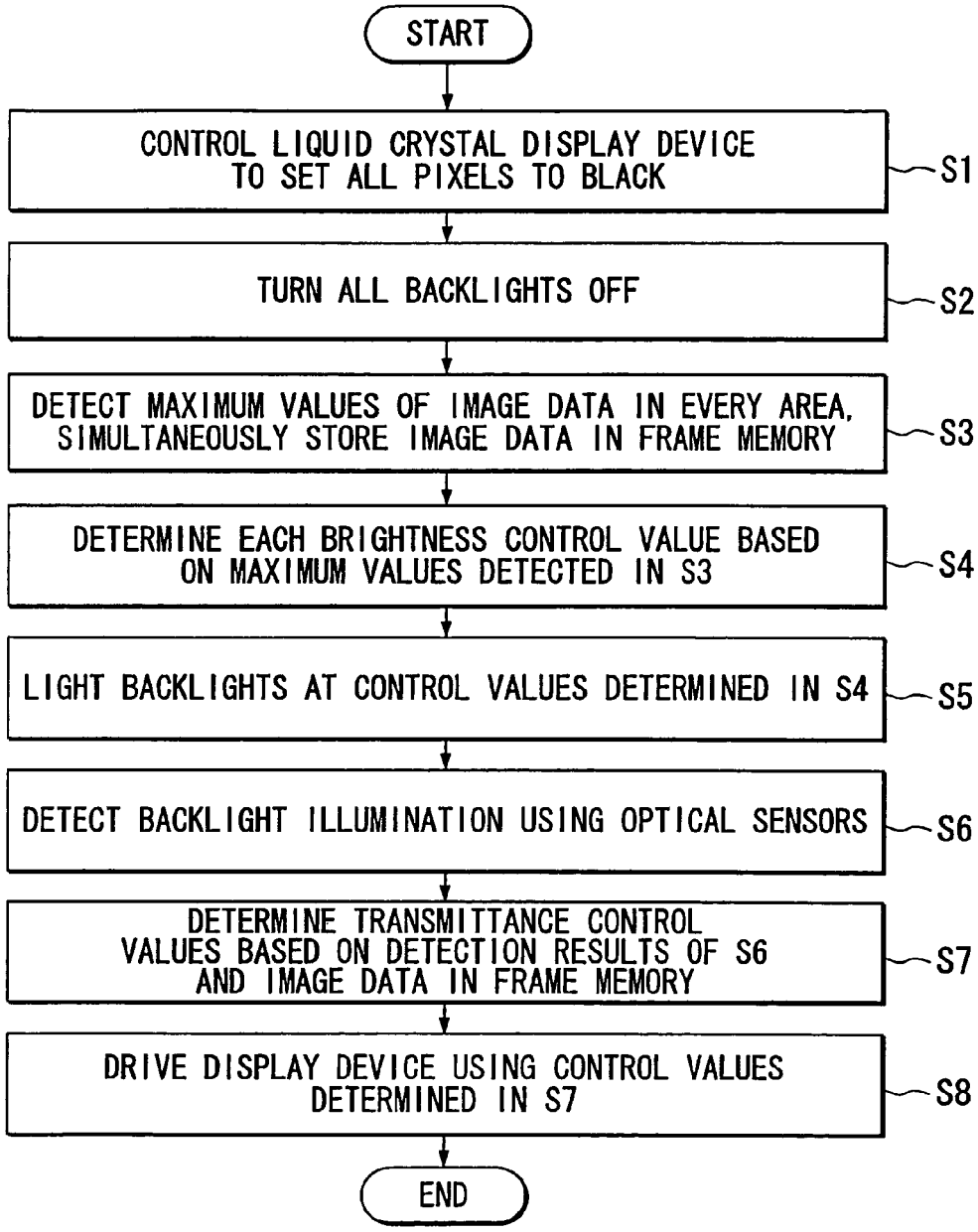
FIG. 5 is a flowchart explaining an example of operation of the image display device in the first embodiment of the invention.
Figure 6:
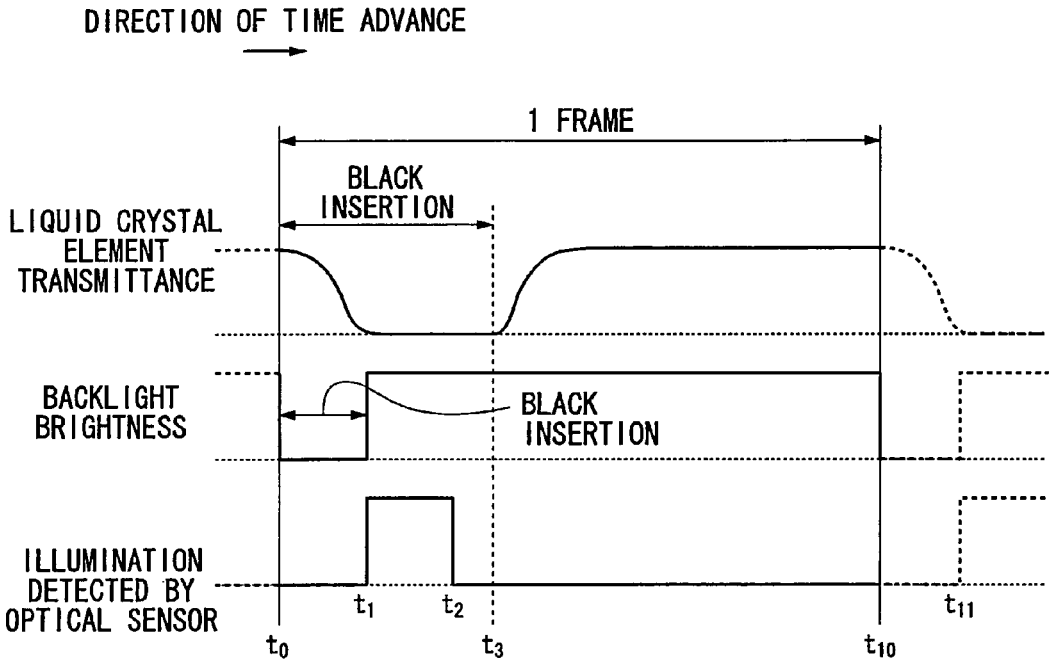
FIG. 6 is a timing chart explaining an example of operation of the image display device in the first embodiment of the invention.

FIG. 5 is a flowchart showing an example of operation to control the liquid crystal element of one pixel in one frame in the image display device of FIG. 1. FIG. 6 is a timing chart corresponding to the flowchart of FIG. 5.

Here, an explanation is given assuming the pixel area is formed from the pixels of the three rows in Part (a) and Part (b) of FIG. 2, and that illumination detection areas is included in one pixel, that is, that one optical sensor is provided on each pixel.

At time $t_0$, at which parallel input of the identical image data to the backlight control section 1 and to the display device control section 2 is begun, the display device driving section 24 executes control to display black (transmittance "0") in all the pixels of the liquid crystal display device (step S1).

With the same timing, the backlight driving section 12 performs black insertion to turn all the backlights L off (step S2).

This is performed in order to use the transient period of the liquid crystal response in step S1 as a mask, to enhance the effectiveness of black insertion.

When the image data is input as time-series data, input image data is stored sequentially in the frame memory 21.

That is, in order to determine the control steps for each of the backlights L, one entire frame's worth of image data must first be input, and the maximum grayscales detected for each of the pixel areas; hence one entire frame's worth of image data is stored in the frame memory 21.

Furthermore, the backlight control value determination section 11 detects the maximum grayscale value in each pixel area from the input image data for each pixel area.

That is, the backlight control value determination section 11 detects the maximum grayscale value from among the image data displayed in the three rows of pixels which are each of the pixel areas (step S3).

Then, from a table which associates in advance grayscales with brightness control values for use as brightness control steps, the backlight control value determination section 11 reads brightness control values (voltage values) which serve as backlight brightness control steps corresponding to each of the pixel areas, according to the maximum grayscale values obtained for each pixel area (step S4).

Next, at time $t_1$, the backlight driving section 12 lights each of the backlights at a luminance corresponding to the brightness control values, according to the brightness control values input from the backlight control value determination section 11 (step S5).

Then, between times $t_1$ and $t_2$, the illumination detection section 22 determines the illumination data T for each illumination detection area from the illumination values detected by the optical sensors S, positioned in each illumination detection area, that is, in each pixel (step S6).

Next, the LCD pixel control value determination section 23 corrects the grayscales of the image data corresponding to the above illumination data T, to determine the corrected grayscales.

At this time, the LCD pixel control value determination section 23 has a table indicating the correspondence between the illumination data T and grayscales, and corrected grayscales, and reads the corrected grayscale corresponding to input illumination data T and grayscale value from the table, to determine the transmittance control value corresponding to the corrected grayscale (step S7).

In step S7, the LCD pixel control value determination section 23 inputs, in order from the illumination detection section 22, illumination data for illumination detection areas including pixels in which image data input from frame memory 21 is displayed.

Next, at time $t_3$, the display device driving section 24 controls the transmittance of liquid crystal elements through transmittance control values input from the LCD pixel control value determination section 23 (step S8).

Then, at time $t_{10}$, similarly to time to, the display device driving section 24 performs black display control for all the liquid crystal elements, and the backlight driving section 12 performs black insertion by turning all the backlights L off.

Thereafter, similar display processing is performed for the liquid crystal elements of each pixel of the liquid crystal display device 3.

In this invention, the LCD pixel control value determination section 23 takes as input from the illumination detection section 22 the illumination data T corresponding to each pixel input from frame memory 21.

As shown in Part (a) and Part (b) of FIG. 2, when a three-pixel by three-pixel area P is an illumination detection area, each time image data corresponding to the pixels of this illumination detection area P is input from the frame memory 21, the LCD pixel control value determination section 23 takes as input illumination data T for the illumination detection area P from the illumination detection section 22.

When in this way an illumination detection area is formed from a plurality of pixels, and when optical sensors are provided on pixels, respectively, as shown in Part (a) and Part (b) of FIG. 2, the optical sensor in any of the pixels in the illumination detection area is used as representative; however, an optical sensor may be formed only in one of the pixels of the illumination detection area.

As explained above, in this embodiment control of the backlight brightness and detection of the illumination distribution is performed every one frame; but in order to reduce the processing burden, processing may be performed every a plurality of frames.

That is, as explained in step S3 and step S4, the backlight control value determination section 11 detects the maximum value of grayscales of the pixels in "k" frames (where "k" is an integer greater than or equal to 2) and reads from a table the brightness control value corresponding to this grayscale, to set the backlight brightness control value every "k" frames.

For example, in the first frame among "k" frames for which the brightness control value is to be determined, the backlight control value determination section 11 detects the maximum values of grayscales of the pixels in the pixel areas for the frame, and takes these grayscales to be the maximum values of grayscales of the pixels for each of the pixel areas.

As a result, over the above-described "n" frames, the backlight driving section 12 drives the backlights as described in step S5 using the same brightness control values.

Then, the illumination detection section 22 performs illumination detection every "k" frame, as described in step S6, synchronized with the brightness control value setting processing by the backlight control value determination section 11 described above.

For example, the illumination detection section 22 determines the illumination data T in each illumination detection area with the timing of lighting of the backlights in the first frame of "k" frames, as described in step S6.

Furthermore, in each frame, that is, every single-frame, the LCD pixel control value determination section 23 determines corrected grayscales for each pixel, based on illumination data measured by the illumination detection section 22 and on grayscales of the pixel data, as described in step S7.

Then, the display device driving section 24 controls the liquid crystal display device 3 using the above corrected grayscales every single-frame, as described in step S8.

Figure 7:
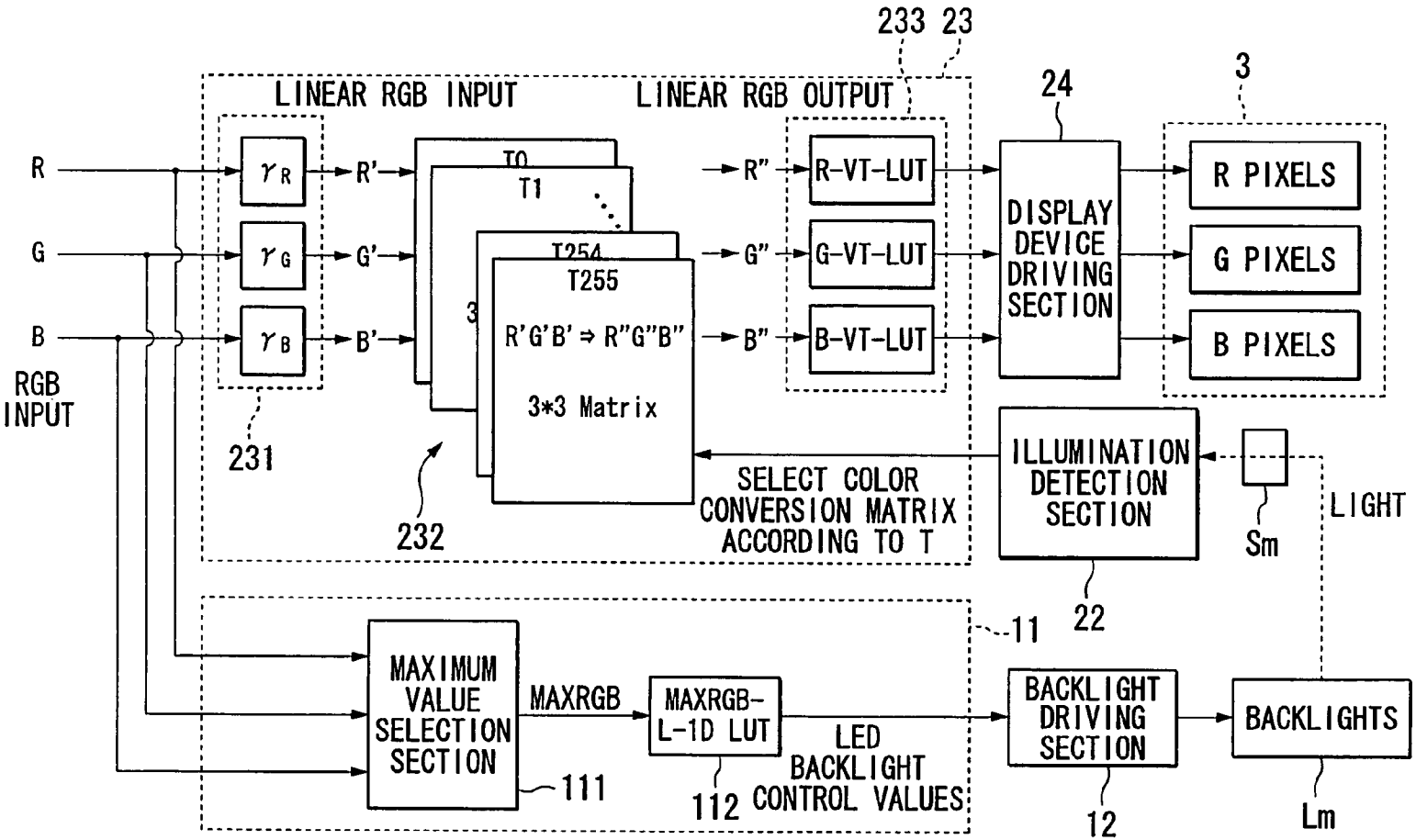
FIG. 7 is a conceptual diagram explaining operation of the backlight control value determination section and LCD pixel control value determination section of FIG. 1.

Next, a configuration is explained for determining backlight brightness control values and transmittance control values of liquid crystal elements of the liquid crystal display device 3 in the embodiment, referring to FIG. 7.

FIG. 7 is a block diagram explaining the backlight control value determination section 11 and LCD pixel control value determination section 23 in the block diagram of FIG. 1.

Here, image data is assumed to have grayscales for R, G, and B.

The backlight control value determination section 11 has a maximum value selection section 111 and a lookup table MAXRGB-L-1DLUT.

The maximum value selection section 111 detects and selects the maximum grayscale value in each of the pixel areas for the input image data (R, G, and B).

That is, if a pixel area includes three rows by six columns, having 18 pixels, then the maximum value MAXRGB is determined as the maximum among the image data R, G, and B values corresponding to the 18 pixels.

The lookup table MAXRGB-L-1DLUT 112 outputs brightness control values for backlights L, corresponding to input MAGRGB values, which are necessary when displaying the MAGRGB values.

That is, the table MAGRGB-L-1DLUT 112 stores grayscales in association with brightness control values (voltage values), determined by measurements made in advance, to display the grayscale.

For example, the table MAXRGB-L-1DLUT 112 stores in a table the result of measurements of the brightnesses for each control step and the brightness control values, corresponding to the characteristics for each backlight.

The backlight driving section 12 lights each of the backlights at the prescribed control step using the above brightness control values.

The LCD pixel control value determination section 23 includes an inverse-γ correction section 231, a matrix table 232, and a control value lookup table 233.

The inverse-γ correction section 231 converts grayscales R, G, and B of input image data, which have been γ-corrected, into linear grayscales R', G', B'.

Hereby, luminance values can be reproduced with high precision.

The illumination detection section 22 detects the illumination distribution resulting from backlight irradiation for each illumination detection area, and outputs detected illumination values from the optical sensors S as illumination data T.

The matrix table 232 is a color conversion matrix table; one among a plurality of correction tables (T0 to Tr) corresponding to the above illumination data T is selected, and corrected grayscales R", G", B" corresponding to the grayscales R', G', B' input to the selected correction table are output.

The control value table 233 outputs transmittance control values, which control the transmittances of R, G, and B pixel of liquid crystal elements according to each of the input corrected grayscales R", G", B".

The liquid crystal display device driving section 24 controls the transmittance of each of the R, G, and B pixel liquid crystal elements of the liquid crystal display device 3, corresponding to transmittance control values output from the control value table 233.

Second Embodiment

Below, the image display device of a second embodiment of the invention is explained, referring to the drawings.

Figure 8:
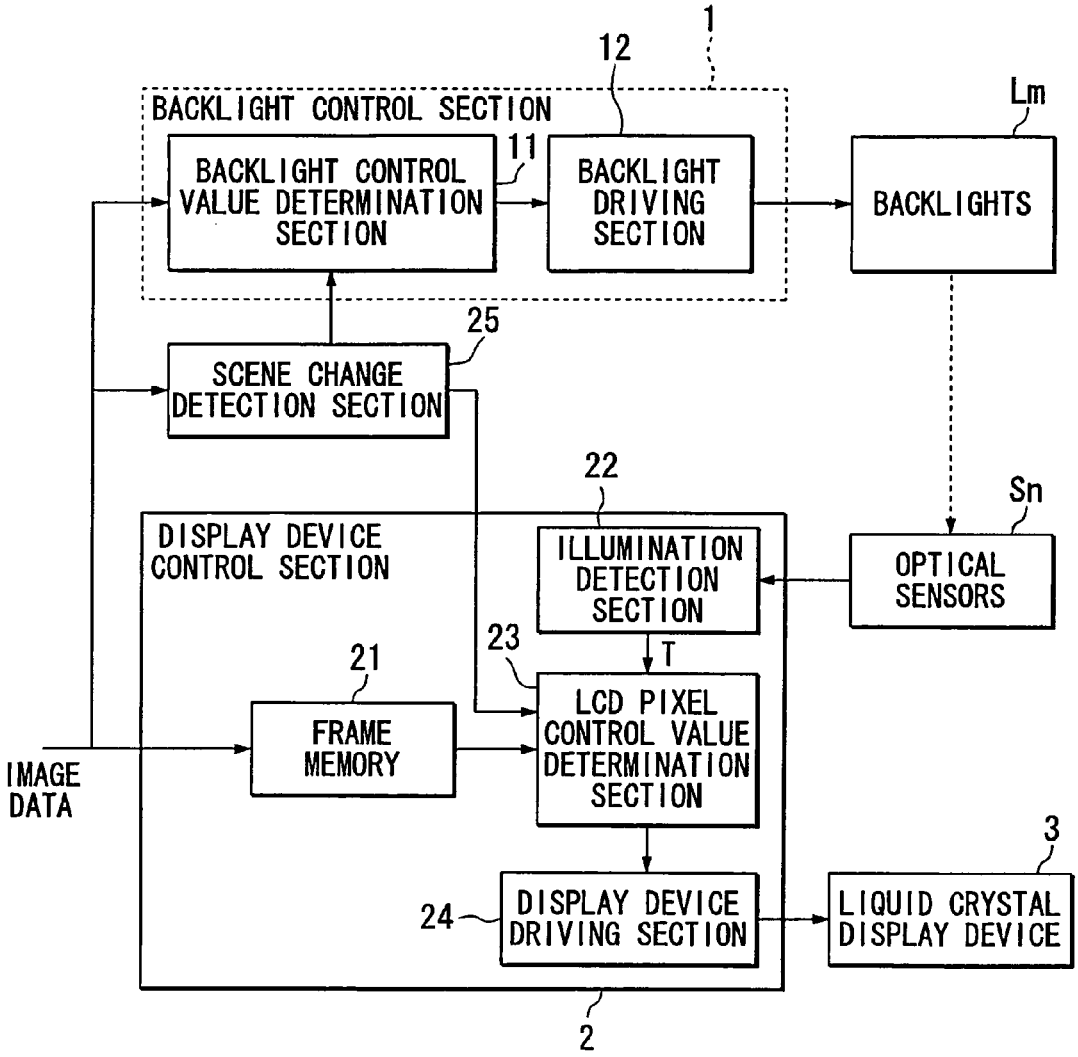
FIG. 8 is a block diagram showing the configuration of the image display device of a second embodiment of the invention.

FIG. 8 is a block diagram showing an example of the configuration in this embodiment.

In the figure, sections which are similar to those of the first embodiment in FIG. 1 are assigned the identical symbols, and explanations are omitted.

Below, the configuration and operation are explained only with respect to differences with the first embodiment.

In this embodiment, optical sensors S are provided in each of the three sub-pixels, for R (red), G (green), and B (blue), which form one pixel.

As explained above, the sub-pixels in this embodiment correspond to R, G, and B pixels.

In this embodiment, a single sub-pixel is explained as follows, similarly to a single pixel in the first embodiment.

The backlight control value determination section 11 determines backlight control values corresponding to the R, G, and B grayscales of the input image data, similarly to the first embodiment, and outputs these backlight control values to the backlight driving section 12.

The backlight driving section 12 determines voltage values corresponding to the above backlight control values for each backlight corresponding to a pixel area, drives the respective backlights at these voltage values, and executes brightness control to light the backlights at the maximum grayscales for the corresponding pixel areas.

The illumination detection section 22 detects the illumination distributions for backlights Lm driven according to the above backlight control values.

Here, the illumination detection section 22 uses the optical sensors S provided in every sub-pixel to detect the illumination distribution resulting from the backlights, and outputs the detection results to the LCD pixel control value determination section 23.

Here, each of the backlights illuminates the liquid crystal display device 3, and the illumination detection section 22 employs the sensors S to detect the illumination distribution.

Thereby, similarly to the first embodiment, the display surface of the liquid crystal display device 3, on which a plurality of pixels is formed, is vided into a plurality of illumination detection areas each including "n" sub-pixels (where "n" is 1 or greater than 1), and one optical sensor S is provided in each of the illumination detection areas.

For example, in this embodiment, the illumination detection section 22 uses the optical sensors S provided in each sub-pixel, with "n"=1, measures illumination values for each sub-pixel, which is an illumination detection area, and outputs the results to the LCD pixel control value determination section 23.

The LCD pixel control value determination section 23 corrects the R, G, and B grayscales for each pixel stored in frame memory 21, using the illumination values input from the illumination detection section 22, and outputs transmittance control values corresponding to the corrected grayscales to the corresponding R, G, and B sub-pixels (display elements) of the liquid crystal display device 3.

The scene change detection section, upon detecting input of image data having grayscales the luminance of which cannot be reproduced given the current backlight illumination distribution, due to a large change in the grayscale values of image data, outputs detection results indicating the inability to reproduce luminances to the backlight control section 1 and to the display device control section 2.

Figure 9:
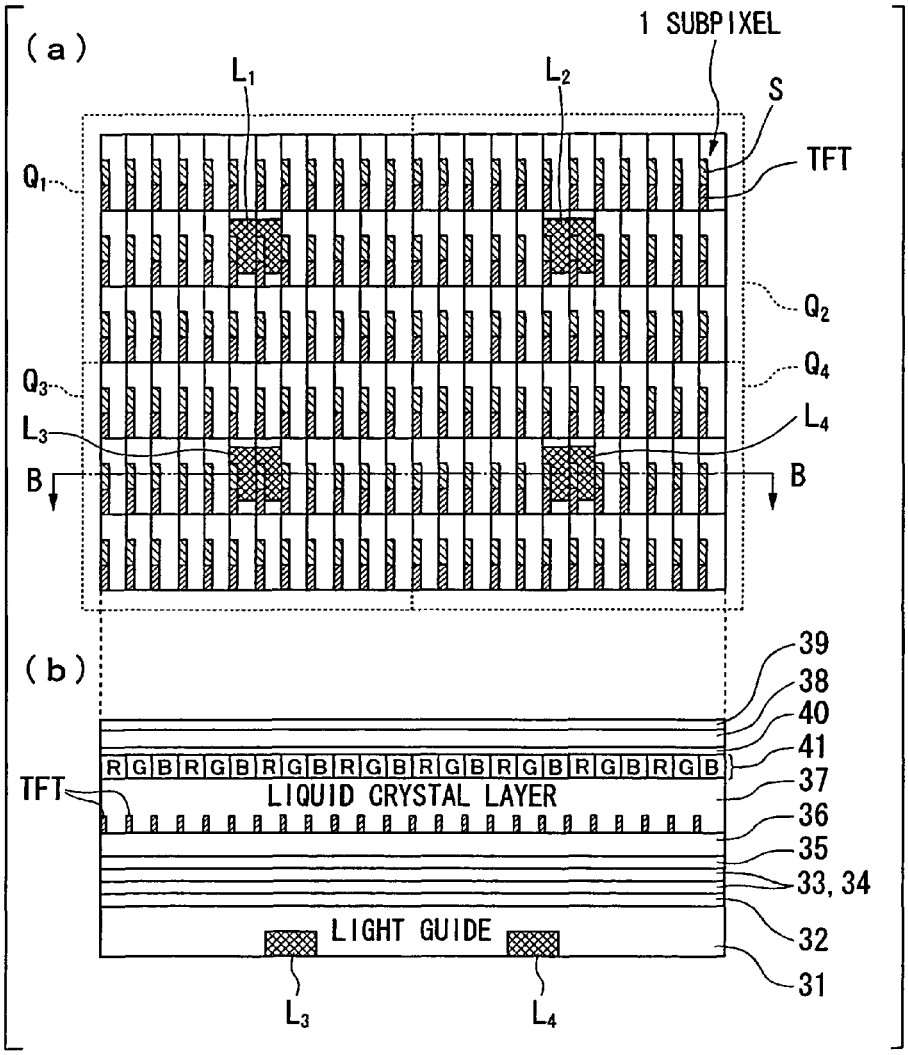
FIG. 9 is a conceptual diagram, in which Part (a) and Part (b) show the configuration of a liquid crystal display device in the image display device of FIG. 8.

Next, Part (a) and Part (b) of FIG. 9 are used to explain the relation between backlights and pixel areas and the relation between optical sensors and illumination detection areas.

Part (a) and Part (b) of FIG. 9 are conceptual diagrams showing the display hardware configuration, including the arrangement of backlights and optical sensors, in the liquid crystal display device 3 of this embodiment.

Part (a) of FIG. 9 shows the surface of the liquid crystal display device 3, and Part (b) of FIG. 9 is a conceptual diagram showing the cross-sectional along line B-B in Part (a) of FIG. 9.

The liquid crystal display device 3 includes, for example, in order from the lower layers as shown in Part (b) of FIG. 9, a guide plate 31, a diffusion plate 32, prism sheets 33 and 34, a polarizing plate 35, a transparent substrate 36, a liquid crystal layer 37, a color filter 41, a transparent electrode 40, a transparent substrate 38, and a polarizing plate 39.

The liquid crystal display device 3 is for example an active matrix-type LCD (Liquid Crystal Display) using TFTs (thin film transistors), including eight horizontal pixels by six vertical pixels (that is, a matrix of six rows by eight columns), for a total of 48 pixels.

Here, because one pixel includes R, G and B sub-pixels, a liquid crystal display device display surface is formed from a total of 48×3=144 sub-pixels.

Here, each sub-pixel corresponds to one of the three primary colors R, G, and B, and sub-pixels are positioned periodically such that, in the above matrix, edges are not in contact and sub-pixels are not adjacent.

The display surface of the liquid crystal display device 3 is divided into four divided portions, and in each divided portion, one of a total of four backlights, L1, L2, L3, and L4 (that is, in FIG. 8, m=4) is positioned in the center of the divided portion in the guide plate 31, such that light is illuminated onto each of the divided portions within the guide plate 31.

Hence for the positioning of the above backlights L, pixel areas (areas Q1, Q2, Q3, and Q4 in Part (a) of FIG. 9) include three rows by 12 columns of sub-pixels included by the blocks Q1, Q2, Q3, and Q4 of the liquid crystal display device 3.

Here, block Q1 is an area corresponding primarily to the backlight L1, block Q2 is an area corresponding primarily to the backlight L2, block Q3 is an area corresponding primarily to the backlight L3, and block Q4 is an area corresponding primarily to the backlight L4.

One optical sensor S is provided on each sub-pixel (corresponding to a pixel in Part (a) and Part (b) of FIG. 2 in the first embodiment) (that is, "n"=1 in FIG. 8); in other words, an illumination detection area includes a single sub-pixel, and the optical sensors S are formed on the identical transparent substrate 36 with the TFTs, and measure the illumination of light emitted from the transparent substrate 36.

That is, the direction of light reception of the optical sensors S is the vertical downward direction (the direction opposing the diffusion plate 32) with respect to the surface of the liquid crystal display device 3, in order to measure the illumination of light illuminated from the backlights L.

Here, by setting "n"=1, when setting transmittance control values for display elements for each sub-pixel, the LCD pixel control value determination section 23 reads from reads from the illumination detection section 22 the optical sensor illumination data T corresponding to the sub-pixels displaying image data and, for the grayscales of each sub-pixel of the image data read in sequence from frame memory 21, determines the transmittance control values for the liquid crystal elements of each sub-pixel of the liquid crystal display device.

In other words, the processing circuitry is made extremely simple.

Here, illumination data T includes a plurality of illumination data values corresponding to R, G and B; although explained below, RS is an R sub-pixel illumination data value, GS is a G sub-pixel illumination data value, and BS is a B sub-pixel illumination data value.

By forming the optical sensors S on the transparent substrate 36 identical with the TFTs, similarly to the first embodiment, semiconductor processes can be made common with those to fabricate the TFTs, and by forming the optical sensors S simultaneously with the TFTs, processes to manufacture liquid crystal display devices 3 are simplified, and the effect of mass production facilitates cost reductions.

Furthermore, as shown in Part (b) of FIG. 9, the backlights L1, L2, L3, and L4 (LED light sources) are direct-type backlights which illuminate the diffusion plate 32 of the liquid crystal display device 3 from directly below.

Light illuminated from each of the backlights L1, L2, L3, and L4 is reflected upward by the guide plate 31 so as to become substantially uniform in the left-right direction in Part (b) of FIG. 9, and is incident onto the diffusion plate 32.

Then, light passing through the diffusion plate 32 is rendered uniform by the prism sheets 33 and 34, and is incident onto the polarizing plate 35, so that the polarization becomes uniform.

This light with uniform polarization passes through the transparent substrate 36, on which the TFTs and optical sensors S are formed, and the polarization state is modulated by the liquid crystal layer 37, the orientation of the liquid crystal layer 37 is controlled by the transmittance control values applied to the TFTs.

The light with modulated polarization state is emitted from the liquid crystal layer 37, passes through the R, G, and B color filter 41, in one-to-one correspondence with each sub-pixel, becoming colored light with the respective colors, and passing through the transparent substrate 38; in the emission-side polarizing plate 39, the quantity of colored light emitted is determined by the polarization state.

Figure 10A:
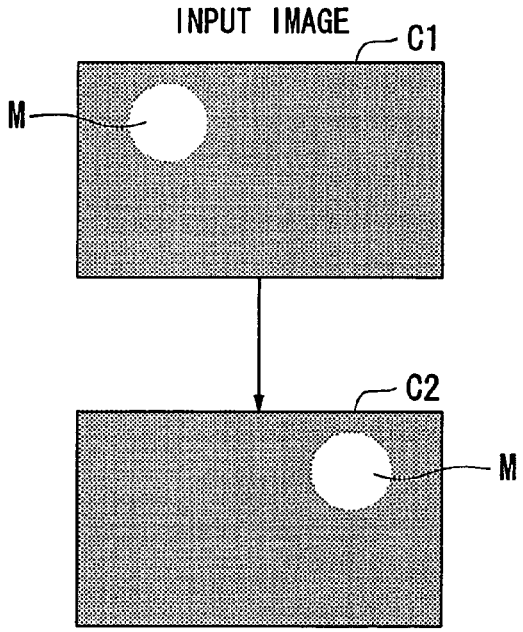
FIGS. 10A and 10B are conceptual diagrams explaining an example of operation of the scene change detection section in the second embodiment of the invention.
Figure 10B:
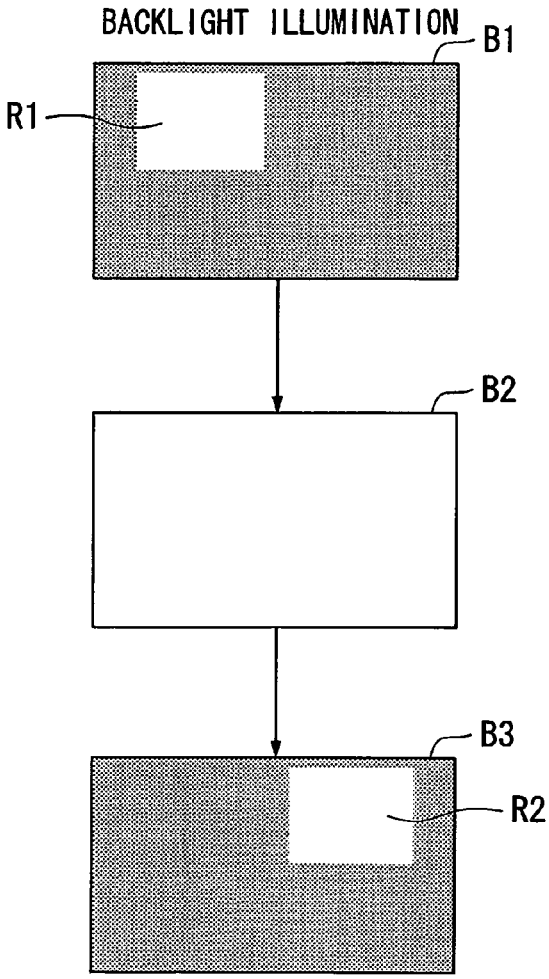

Next, concepts underlying processing in this embodiment are explained for the example of a scene change in FIGS. 10A and 10B.

As shown in FIG. 10A, in a scene of "a full moon in the night sky" as image data, in frame C1 the full moon M is present in an area in the upper-left of the display screen.

In the case of this scene in frame C1, as indicated by the backlight illumination pattern B1 in FIG. 10B, the illumination is made high only for the backlight corresponding to area R1 in the upper-left, in which the full moon is present, while the illumination of the backlights corresponding to the areas in the upper-right, lower-left, and lower-right are made low (or the backlights are turned off).

Hereby, other portions of the night sky are more deeply black, whereas the full moon M shines brightly compared with the night-sky portions, and video with extremely high contrast can be displayed on the display screen.

At the same time, illumination can be turned off or reduced in areas other than the area in which the full moon M exists; that is, the backlight illumination can be turned off or reduced in areas of the night sky which occupy a large fraction of the screen area, so that substantial power conservation can be achieved.

Moreover, in this embodiment the optical sensors S provided in each sub-pixel are used to detect in every sub-pixel, as illumination detection areas, the illumination with which, for example, the backlight illumination is incident onto the liquid crystal layer 37 (Part (a) and Part (b) of FIG. 9).

Hence as already explained, the transmittance control values for display elements in each sub-pixel are determined from the illumination of light from the backlights incident onto the liquid crystal layer 7, and from the grayscales for each pixel (R, G, and B) of image data to be reproduced and displayed; hence the grayscales of the image data can be reproduced as luminance values with high precision.

However, in this embodiment, if the display screen illumination distribution were detected by the optical sensors S every frame, similarly to the first embodiment, increase circuit costs would result; hence illumination distribution detection by the optical sensors S is performed every the period of a plurality "k" of frames (where "k" is an integer equal to or greater than 2), such as for example once every four frames (that is, "k"=4).

In other words, the illumination distribution due to backlight illumination, corresponding to brightness control values set in the initial frame, is held over the period of "k" frames.

However, in the image data of normal input video, there are few significant changes in the grayscales of pixels in frames, and often resolution is possible through fine adjustment of transmittance control values for the sub-pixel display elements in the liquid crystal display device 3, so that no problems arise from normal input video.

However, when the grayscale distribution of the image to be reproduced changes greatly between preceding and succeeding frames, there exist cases in which the scene changes so that, for example, as shown in FIG. 10A, the full moon M in the upper-left of the display image in frame C1 moves to the area in the upper-right of the display screen, in the next frame C2.

In this embodiment, a scene change is defined to be a prominent change in scene such as this.

When a scene change such as that described above occurs, there are many cases in which a luminance which reproduces the grayscales for all the pixels of the image data cannot be realized given the current backlight illumination distribution.

For example, in the example of FIG. 10B, with the illumination distribution unchanged from the state in which only the night sky is displayed in the upper-right area of the display screen, the full moon M cannot be reproduced, with luminance corresponding to the grayscales of the image data, in the upper-right area of the display screen.

In order to avoid the above-described problem, in this embodiment, when the scene change detection section 25 detects a scene change, the backlight control value determination section 11 causes all the backlights L1 to L4 to be driven to change to full-screen dimming mode, at a brightness control value enabling reproduction of luminance values corresponding to the maximum grayscales on the display screen, as shown in the illumination pattern B2 of FIG. 10B.

Then, with the timing of detection of the illumination distribution over the period of "k" frames by the illumination detection section 22, the backlight control value determination section 11 returns to an area dimming mode, in which the illumination is raised in only the upper-right area R2 of the display screen, in which the full moon M exists, while the illumination of backlights corresponding to the upper-left, lower-right, and lower-left areas is lowered (or turned off), as indicated by the illumination pattern B3 in FIG. 10B.

Hereby, even when detecting the illumination distribution once in a period of "k" frames, when there is a scene change in which the grayscale values of pixels of the image data change greatly between frames, failure of high-precision display processing of the image data can be prevented.

Hence by this embodiment, a simple circuit can be used to reproduce high luminance values corresponding to the grayscales of each of the pixels of the image data, so that both high image quality and power conservation can be achieved simultaneously at low cost.

Figure 11:
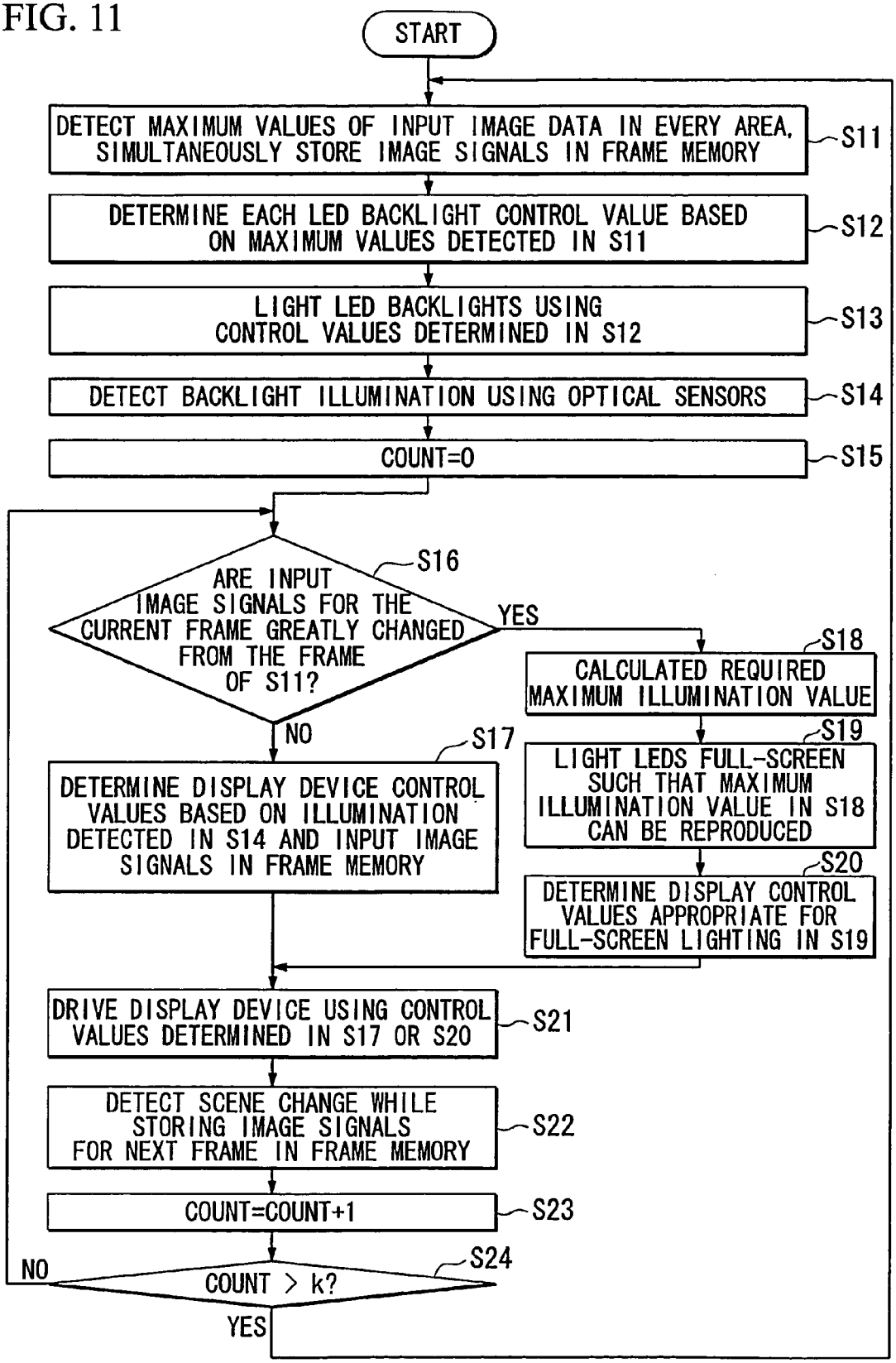
FIG. 11 is a flowchart explaining an example of operation of the image display device of the second embodiment of the invention.

Next, FIGS. 8 and 11 are used to explain operation of the image display device of this embodiment.

FIG. 11 is a flowchart showing an example of operation to control the liquid crystal element of one sub-pixel, when performing processing to detect the backlight illumination distribution in the first frame of a k-frame period in the image display device of FIG. 8.

Here, an explanation is given in which pixel areas are formed from blocks Q1, Q2, Q3 and Q4 in Part (a) and Part (b)

of FIG. 9, and illumination detection areas include a single sub-pixel; that is, one optical sensor S is provided on each sub-pixel.

When the same image data begins to be input in parallel to the backlight control section 1 and to the display device control section 2, the display device driving section 24 executes control such that all the pixels of the liquid crystal display device display black (transmittance "0").

Also, with the same timing, the backlight driving section 12 performs black insertion to turn all the backlights L off.

Here, the liquid crystal transient period is used as a mask to improve the effect of black insertion.

Then, when image data is input as a time series, the backlight control value determination section 11 detects the maximum grayscale values MAXRGB of sub-pixels every pixel area from the input image data.

That is, the backlight control value determination section 11 detects the maximum grayscale values from among the image data sub-pixels displayed in each of the blocks Q1, Q2, Q3, and Q4, which are each pixel areas.

Similarly to the first embodiment, the frame memory 21 stores input image data in sequence, in order to be used when determining the transmittance control values of display pixels for each sub-pixel (step S11).

Then, the backlight control value determination section 11 reads, from a table which associates in advance grayscales with brightness control values to obtain brightness control steps, brightness control values (voltage values) to become brightness control steps for the backlights corresponding to the respective pixel areas, according to the maximum grayscale values MAXRGB obtained for each pixel area (step S12).

The brightness control values are set to values which enable reproduction of luminance values corresponding to the grayscales of each of the sub-pixels of the image data when the display element transmittance is set to the maximum value.

When brightness control values are set, the backlight driving section 12 lights the backlights L1, L2, L3, and L4 at illuminations corresponding to the respective brightness control values, according to the brightness control values input from the backlight control value determination section 11 for each of the backlights (step S13).

When the backlights are lit, the illumination detection section 22 determines illumination data T (for each sub-pixel RS, GS, and BS) for each of the illumination detection areas from the detected illumination values of each of the optical sensors positioned in each illumination detection area, that is, in each sub-pixel (step S14).

Then, the illumination detection section 22 resets to "0" the count value COUNT of the counter to detect the timing of the k-frame period for illumination distribution detection (step S15).

Next, the scene change detection section 25 detects whether there has been a large change in the grayscales of the image data (a scene change) stored in current frame memory 21, relative to the immediately preceding image data.

Specifically, when in the above step S11 image data is stored in frame memory 21, the scene change detection section 25 detects whether the grayscales of input image data can be reproduced for the current illumination distribution.

When the detection results of the scene change detection section 25 indicate that there has been no scene change, processing proceeds to step S17; if the occurrence of a scene change is detected, processing proceeds to step S18 (step S16).

For example, in step S16, when image data is input to frame memory 21, the scene change detection section 25 performs comparisons for all sub-pixels in the time-series input order to determine whether the grayscales for each sub-pixel in the image data can be reproduced for the current illumination distribution in each pixel area.

When sub-pixels with grayscales that cannot be reproduced are detected in the scene change detection section 25, the scene change detection section 25 notifies the backlight control value determination section 11 and LCD pixel control value determination section 23 of the detection of a scene change.

That is, the scene change detection section compares the grayscales of sub-pixels in all the pixels of the input image data with the range of grayscales which can be displayed for the current brightness control values of each of the backlights, and depending on whether the grayscale values of the sub-pixel for all pixels are within the above range, determines whether image data which cannot be reproduced at the current light source illuminations has been input.

Furthermore, in step S16, the scene change detection section 25 may store a histogram of grayscales for each sub-pixel in the image data of the immediately preceding frame (with grayscales along the horizontal axis and the number of sub-pixels along the vertical axis).

Furthermore, the scene change detection section 25 may compare the stored histogram of the immediately preceding frame with a histogram of the grayscales of sub-pixels when storing image data for a frame to be displayed in frame memory 21.

In addition, when a change in a histogram equal to or greater than a preset amount is detected, the scene change detection section 25 may detect the fact that a scene change has occurred, as disclosed in Japanese Unexamined Patent Application No. 2004-45634.

Next, in step S17, the LCD pixel control value determination section 23 corrects the grayscales of the R, G, and B of the sub-pixels for each pixel of the image data according to the above illumination data T, to determine the corrected grayscales.

At this time, the LCD pixel control value determination section 23 has a table indicating the correspondence between illumination data T and grayscales and the corrected grayscales, and at this time reads from this table the corrected grayscales corresponding to the input illumination data T and grayscales, determines transmittance control values corresponding to the corrected grayscales, and proceeds to the processing of step S21 (step S17).

Next, in step S21, the display device driving section 24 controls the transmittance of liquid crystal elements by the transmittance control values input from the LCD pixel control value determination section 23 (step S21).

Then, when storing the image data to be displayed next in frame memory 21, the scene change detection section 25 detects whether a large change has occurred in the grayscales of the image data currently stored in frame memory 21 relative to the currently displayed image data, that is, detects whether the grayscales of the image data input can be reproduced for the current illumination distribution (step S22).

Then, the illumination detection section 22 increments (adds "1" to) the numerical value COUNT of a counter to detect the timing of the k-frame interval for detection of the illumination distribution (step S23).

After incrementing the numerical value COUNT, the illumination detection section 22 detects whether the numerical value COUNT has exceeded the preset value "k" (the number of frames of the period for detecting the illumination distribution); when it is detected that the numerical value COUNT has exceeded the preset value k, processing proceeds to step S11, because the k-frame period has ended and area dimming is to be performed.

On the other hand, when the illumination detection section 22 detects that the numerical value COUNT is equal to or less than k, the k-frame period has not yet ended, and so processing proceeds to step S16 (step S24).

In this step S24, when processing proceeds to step S16, the display device driving section 24 performs black display control of the liquid crystal elements for all pixels, and the backlight driving section 12 performs black insertion to turn all the backlights L1 to L4 off.

In step S16, when a scene change is detected, the backlight control value determination section 11 determines the maximum grayscale MAXRGB among the subgrayscales of the pixels for all pixels of the image data stored in frame memory 21, in order to perform full-screen dimming.

The backlight control value determination section 11 reads, from a table which associates in advance grayscales and brightness control values to yield brightness control steps, brightness control values resulting in brightness control steps for the backlight corresponding to the above-described maximum grayscale MAXRGB (step S18).

When brightness control values are determined, the backlight driving section 12 lights each of the backlights L1, L2, L3, and L4 at an illumination corresponding to the same brightness control value, according to the brightness control values input from the backlight control value determination section 11 (step S19).

When each of the backlights is lit, the illumination detection section 22 determines illumination data T (RS, GS, and BS for sub-pixels) for each illumination detection area from the detected illumination values of the optical sensors S positioned in each illumination detection area, that is, in each of the sub-pixels.

Similarly to step S17, the LCD pixel control value determination section 23 corrects the grayscales for each of the R, G, and B sub-pixels of each pixel of the image data, according to the above illumination data, to determine the corrected grayscales, and processing proceeds to step S21 (step S20).

Hereafter, display processing similar to the flowchart of FIG. 11 above is performed for the liquid crystal elements of each sub-pixel of the liquid crystal display device 3.

Figure 12:
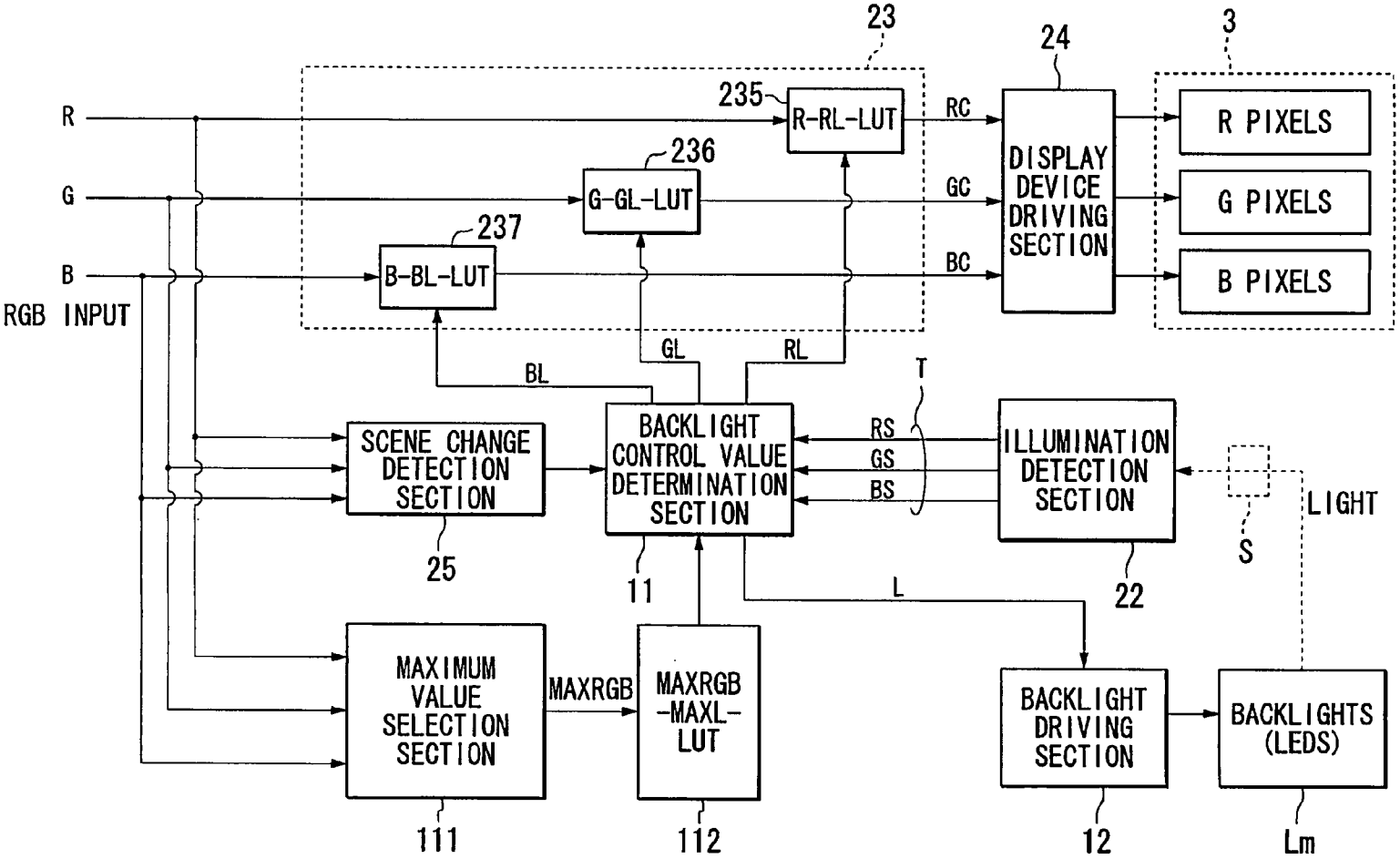
FIG. 12 is a conceptual diagram explaining operation of the backlight control value determination section, LCD pixel control value determination section, and scene change detection section of FIG. 8.

Next, FIG. 12 is referenced to explain a configuration in which the backlight brightness control values and the transmittance control values of all the liquid crystal elements of the liquid crystal display device 3 are determined, taking into account scene changes between earlier and later frames occurring in image processing to detect backlight illumination distributions in k-frame periods in this embodiment.

FIG. 12 is a block diagram which explains in detail the backlight control value determination section 11, LCD pixel control value determination section 23, and scene change detection circuit 25 in the block diagram of FIG. 8.

Here, the image data is assumed to have grayscales for each of the R, G, and B sub-pixels in each pixel.

The scene change detection section 25 performs detection of the occurrence of a scene change between frames by comparing the image data input to frame memory 21 with the immediately preceding image data, and when a scene change is detected, notifies the backlight control value determination section 11 of the detection of a scene change.

The backlight control value determination section 11 is additionally provided with a maximum value selection section 111 and with a lookup table MAXRGB-L-1DLUT.

The maximum value selection section 111 performs selection by detecting the maximum value of the grayscales in each pixel area among the input image data (R, G, and B).

That is, if a pixel area includes three rows by six columns, or 18 pixels, the maximum value selection section 111 determines the maximum value MAXRGB among the R, G, and B values of the image data corresponding to the 18 pixels, and outputs the result to MAXRGB-L-1DLUT 112.

Then, the lookup table MAXRGB-L-1DLUT 112 outputs to the backlight control value determination section 11 the backlight L brightness control value MAXL which is necessary when displaying this MAXRGB value, corresponding to the input sub-pixel MAXRGB value.

This MAXRGB-L-1DLUT 112 determines in advance the characteristics of the sub-pixel display elements.

That is, the table MAXRGB-L-1DLUT 112 stores, in association, subgrayscales of the pixels and brightness control values (voltage values) to display the grayscales, determined in advance by measurements.

For example, MAXRGB-L-1DLUT 112 is a table which stores the measured relationship between brightnesses for each control step and brightness control values, corresponding to the characteristics for each backlight.

When performing area dimming, the backlight control value determination section 11 outputs the input brightness control value MAXL to the backlight driving section 12.

The backlight driving section 12 lights each of the backlights at a control value MAXL corresponding to the pixel area, using prescribed control steps.

Furthermore, the backlight control value determination section 11 causes the maximum value selection section 111 to detect the maximum grayscale value among the grayscales in the entire pixel area, that is, among all the sub-pixels in the image data, obtains the control value corresponding to this maximum grayscale from MAXRGB-L-1DLUT 112, and outputs this brightness control value to the backlight driving section 12.

The backlight driving section 12 lights all the backlights at a prescribed control step using the same brightness control value MAXL.

The illumination detection section 22 outputs to the backlight control value determination section 11, as illumination data T (RS, GS, and BS), detected illumination values from the optical sensors S for each illumination detection area as the illumination distribution resulting from backlight irradiation.

Then, during area dimming, the backlight control value determination section 11 outputs to the LCD pixel control value determination section 23 the input illumination data RS, GS, and BS as the backlight luminance values RL, GL, and BL respectively, and on the other hand, during full-screen dimming, with MAXL as the backlight luminance value, outputs to the LCD pixel control value determination section 23 the backlight luminance values RL, GL, and BL as the numerical values of this MAXL.

The LCD pixel control value determination section 23 has, as lookup tables to convert grayscales corresponding to the R, G, and B sub-pixels into transmittance control values, the tables R-RL-LUT, G-GL-LUT, and B-BL-LUT for the R, G and B sub-pixels respectively.

Here, R-RL-LUT is a lookup table which stores the correspondence relation between R grayscales, backlight luminance values RL for R sub-pixels input from the backlight control value determination section 11, and transmittance control values RC; when an R grayscale and a backlight luminance value RL are input, an R sub-pixel transmittance control value RC is output.

Similarly, G-GL-LUT is a lookup table which stores the correspondence relation between G grayscales, backlight luminance values GL for G sub-pixels input from the backlight control value determination section 11, and transmittance control values GC; when a G grayscale and a backlight luminance value GL are input, a G sub-pixel transmittance control value GC is output.

B-BL-LUT is a lookup table which stores the correspondence relation between B grayscales, backlight luminance values BL for B sub-pixels input from the backlight control value determination section 11, and transmittance control values BC; when a B grayscale and a backlight luminance value BL are input, a B sub-pixel transmittance control value BC is output.

Here, the grayscales and transmittance control values are input, in the order R, G, and B, to the LCD pixel control value determination section 23.

In the above-described image display device of this embodiment, in a configuration in which the illumination of each of the light sources is controlled with the period of a plurality of "k" frames, when displaying image data input upon each frame, even when the grayscales of pixels in every area changes significantly within the above frame period, the illuminations of each of the light sources can be controlled according to the grayscales of the pixels of the image data, so that even when a scene changed entailing a sudden change in grayscales occurs, reproduction of the accurate grayscales of the image data is possible.

A program to realize the processing and functions other than digital/analog conversion in the backlight control value determination section 11 and LCD pixel control value determination section 23 in FIG. 1, or in the backlight control value determination section 11, LCD pixel control value determination section 23, and scene change detection section 25 in FIG. 8, may be recorded on computer-readable recording media, and the program recorded on this recording media may be caused to be read and executed by a computer system, to perform image display control processing.

Here, "computer system" includes an OS, peripheral equipment, and other hardware.

Furthermore, "computer system" includes a WWW system provided with a website provision environment (or display environment).

Furthermore, "computer-readable recording media" may be a flexible disk, magneto-optical disc, ROM, CD-ROM or other removable media, or a hard disk or other storage device incorporated within a computer system.

Also, "computer-readable recording media" includes devices which store programs for a fixed period of time, such as volatile memory (RAM), within a computer system which serves as a server or client when programs are transmitted via the Internet or another network, or over telephone lines or other communication circuits.

Furthermore, the above program may be transmitted from a computer system which stores the program in a storage device or similar to another computer system via transmission media, or via transmission waves in a transmission medium.

Here, the "transmission medium" which transmits the program is a medium having a function of transmitting information, such as the Internet or another network (communication network), or telephone lines or other communication circuits (communication lines).

Furthermore, the above program may realize a portion of the above-described functions.

Moreover, the program may be a differential file (differential program), which realizes the above-described functions in combination with a program already recorded in the computer system.

What is claimed is:

1. An image display device, comprising:

an optical modulation element having a plurality of pixels;

light sources illuminating the optical modulation element, each of which is independently controlled;

a light source control value setting section detecting, in an input image data, a maximum grayscale value among grayscales of the input image data corresponding to pixels included in a pixel area associated with each of the light sources, and determining a brightness control value for each light source corresponding to the maximum grayscale value;

a light source driving section determining a voltage value corresponding to the brightness control value for each pixel area, driving a respective one of the light sources at the brightness control values, and controlling lighting of the respective light source to a brightness corresponding to the maximum grayscale value for the corresponding pixel areas;

an optical sensor provided on an area of each pixel of the optical modulation element to detect a numerical value for each pixel;

an illumination detection section determining an illumination data for each pixel of the optical modulation element based on the detected numerical value for each pixel;

a grayscale control section determining corrected grayscales from the grayscales of the input image data and the illumination data for each pixel of the optical modulation element, and using the corrected grayscales to output a transmittance control value which controls transmittance of the optical modulation element; and an optical modulation driving section using the transmittance control value to control the transmittance of the optical modulation element for each pixel of the image display device, wherein when determining the illumination data to determine the corrected grayscales, the light source control value setting section inputs one entire frame's worth of image data, detects the maximum grayscales for each light source, and determines brightness control values which control illumination of the light source corresponding to the maximum grayscales, the grayscale control section performs black display control so as to display black in all pixels of the optical modulation element during both a first correction processing period and a second correction processing period to determine the corrected grayscales, and the light source driving section turns all of the light sources off during the first correction processing period, and lights each of the light sources according to the brightness control values during the second correction processing period in synchronization with the black display control, the second correction processing period being a period following the first correction processing period.

2. The image display device according to claim 1, wherein the optical sensors and the optical modulation element are formed on the identical substrate.

3. The image display device according to claim 1, wherein the light source control value setting section sets control values for the light sources every "k" frames where the "k" is an integer equal to or greater than 2, the illumination detection section detects the illumination of the areas every "k" frames, and the grayscale control section controls the optical modulation element due to the corrected grayscales every single frame.

4. The image display device according to claim 1, further comprising:

a scene change detection section detecting whether an image data has been input in the period of "k" frames, the image data having grayscales which is impossible to display at a current illumination distribution of light source, wherein the light source control value setting section sets the light sources to a full-screen dimming mode, which is substantially a same illumination corresponding to maximum grayscale in the image data, when the scene change detection section detects that the image data is impossible to display at the current illumination distribution, and wherein the light source control value setting section sets an area dimming mode in which control values for each of the light sources are set according to grayscales of the pixels for the input image at a timing of next illumination detection by the illumination detection section.

5. The image display device according to claim 4, wherein the scene change detection section compares grayscales of all pixels of input image data with the range of grayscales which is possible to display at the current control values of each light source, and wherein the scene change detection section determines whether the image data has been input, the image data being impossible to reproduce at the current illumination of light source due to whether the grayscales of all of the pixels of input image data are within the range.

6. The image display device according to claim 4, wherein the scene change detection section, by detecting a scene change in the image data, determines whether the image data has been input, the image data being impossible to reproduce at the current light source illumination.

7. An image display method, comprising:

illuminating an optical modulation element having a plurality of pixels by light sources, each of the light sources being independently controlled;

detecting, in an input image data, a maximum grayscale value among grayscales of the input image data corresponding to pixels included in a pixel area associated with each of the light sources by a light source control value setting section;

determining a brightness control value for each light source corresponding to the maximum grayscale value by the light source control value setting section;

determining a voltage value corresponding to the brightness control value for each pixel area;

driving a respective one of the light sources at the brightness control values by a light source driving section;

controlling lighting of the respective light source to a brightness corresponding to the maximum grayscale value for the corresponding pixel areas;

detecting an illumination data for each pixel of the optical modulation element by an illumination detection section;

determining corrected grayscales from the grayscales of the input image data and the illumination data for each pixel of the optical modulation element by a grayscale control section;

outputting a transmittance control value which controls transmittance of the optical modulation element using the corrected grayscales; and controlling the transmittance of the optical modulation element for each pixel of the image display device using the transmittance control value by an optical modulation driving section, wherein when determining the corrected grayscales, the light source control value setting section inputs one entire frame's worth of image data, detects the maximum grayscales for each light source, and determines brightness control values which control illumination of the light source corresponding to the maximum grayscales, a grayscale control section performs black display control so as to display black in all pixels of the optical modulation element during both a first correction processing period and a second correction processing period to determine the corrected grayscales, and a light source driving section turns all of the light sources off during the first correction processing period, and lights each of the light sources according to the brightness control values during the second correction processing period in synchronization with the black display control, the second correction processing period being a period following the first correction processing period.

8. The image display device of claim 1, wherein each optical sensor is provided solely to an area of one of the pixels of the optical modulation element.

9. The image display device of claim 1, wherein the light source control value setting section includes a maximum value selection section which detects and selects the maximum grayscale value in each of the pixel areas for the input image data.

10. The image display device according to claim 1, wherein the optical sensors detect the illumination of the pixels in order to obtain an illumination distribution, and the grayscale control section controls the optical modulation element based on the corrected grayscale values for every single-frame using the illumination distribution.

* * * * *